US011349212B2

(12) United States Patent
Kim et al.

(10) Patent No.: US 11,349,212 B2
(45) Date of Patent: May 31, 2022

(54) ANTENNA DEVICE

(71) Applicant: Samsung Electro-Mechanics Co., Ltd., Suwon-si (KR)

(72) Inventors: Nam Ki Kim, Suwon-si (KR); Woncheol Lee, Suwon-si (KR); Dongok Ko, Suwon-si (KR); Jaemin Keum, Suwon-si (KR); Jeongki Ryoo, Suwon-si (KR); Youngsik Hur, Suwon-si (KR)

(73) Assignee: Samsung Electro-Mechanics Co., Ltd., Suwon-si (KR)

( * ) Notice: Subject to any disclaimer, the term of this patent is extended or adjusted under 35 U.S.C. 154(b) by 0 days.

(21) Appl. No.: 17/034,401

(22) Filed: Sep. 28, 2020

(65) Prior Publication Data

US 2022/0013909 A1 Jan. 13, 2022

(30) Foreign Application Priority Data

Jul. 8, 2020 (KR) ..... 10-2020-0084065

(51) Int. Cl.

| | |
|---|---|
| ***H01Q 5/35*** | (2015.01) |
| ***H01Q 1/38*** | (2006.01) |
| ***H01Q 5/15*** | (2015.01) |

(52) U.S. Cl.

CPC ..... *H01Q 5/35* (2015.01); *H01Q 1/38* (2013.01); *H01Q 5/15* (2015.01)

(58) Field of Classification Search

CPC ..... H01Q 1/38; H01Q 5/15; H01Q 5/35

See application file for complete search history.

(56) References Cited

U.S. PATENT DOCUMENTS

| | | | |
|---|---|---|---|
| 8,912,970 | B1 | 12/2014 | Manry, Jr. et al. |
| 2008/0074341 | A1 | 3/2008 | Chung et al. |
| 2012/0162021 | A1 | 6/2012 | Lee et al. |
| 2015/0002359 | A1 | 1/2015 | Dong et al. |

(Continued)

FOREIGN PATENT DOCUMENTS

| | | | |
|---|---|---|---|
| JP | 2002-305409 | A | 10/2002 |
| KR | 10-2008-0028613 | A | 4/2008 |
| KR | 10-2011-0010938 | A | 2/2011 |

(Continued)

OTHER PUBLICATIONS

Lai, Hau Wah et al., "An L-Probe Fed Patch Antenna Loaded with Multiple Dielectric Layers." *2015 IEEE 4th Asia-Pacific Conference on Antennas and Propagation* (*APCAP*). *IEEE*, 2015 (pp. 1-2).

(Continued)

*Primary Examiner* — Hoang V Nguyen
(74) *Attorney, Agent, or Firm* — NSIP Law

(57) ABSTRACT

An antenna device including: a ground plane; an antenna pattern overlapping the ground plane with respect to a first direction; a dielectric layer interposed between the ground plane and the antenna pattern; a feed via coupled with the antenna pattern and penetrating at least a portion of the dielectric layer; a ground via connected to the ground plane and penetrating at least a portion of the dielectric layer; and a ground pattern extending from the ground via and disposed adjacent to a lateral surface of the feed via in a second direction that forms a predetermined angle with the first direction.

20 Claims, 22 Drawing Sheets

(56) References Cited

U.S. PATENT DOCUMENTS

2020/0028269 A1 1/2020 Kim et al.

FOREIGN PATENT DOCUMENTS

| | | | | |
|---|---|---|---|---|
| KR | 10-2012-0072144 | A | 7/2012 | |
| KR | 10-2015-0032992 | A | 4/2015 | |
| KR | 10-2020-0009984 | A | 1/2020 | |
| WO | WO-2019034760 | A1 * | 2/2019 | ..... H01Q 5/335 |

OTHER PUBLICATIONS

Korean Office Action dated Apr. 30, 2021 in counterpart Korean Patent Application No. 10-2020-0084065 (6 pages in Korean).
Korean Office Action dated Nov. 26, 2021, in counterpart Korean Patent Application No. 10-2020-0084065 (2 pages in Korean).

* cited by examiner

ANTENNA DEVICE

CROSS-REFERENCE TO RELATED APPLICATION

This application claims priority to and the benefit under 35 USC 119(a) of Korean Patent Application No. 10-2020-0084065 filed in the Korean Intellectual Property Office on Jul. 8, 2020, the entire contents of which are incorporated herein by reference for all purposes.

BACKGROUND

1. Field

The following description relates to an antenna device.

2. Description of the Background

Millimeter wave (mmWave) communication including 5th generation communication has been actively researched, and research for commercialization/standardization of an antenna device that smoothly implements it has been actively conducted.

Radio frequency (RF) signals of high frequency bands, for example, 24 GHz, 28 GHz, 36 GHz, 39 GHz, and 60 GHz, are easily lost in a process of being transmitted, thus communication quality may deteriorate.

Meanwhile, as a portable electronic device develops, a size of a screen, which is a display area of the electronic device, increases, and accordingly, a size of the bezel, which is a non-display area in which an antenna and the like are disposed, decreases, and accordingly, a size of an area in which the antenna can be installed also decreases.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

An antenna device that may improve performance and realize miniaturization.

In one general aspect, an antenna device includes: a ground plane; an antenna pattern overlapping the ground plane with respect to a first direction; a dielectric layer interposed between the ground plane and the antenna pattern; a feed via coupled with the antenna pattern and penetrating at least a portion of the dielectric layer; a ground via connected to the ground plane and penetrating at least a portion of the dielectric layer; and a ground pattern extending from the ground via and disposed adjacent to a lateral surface of the feed via in a second direction that forms a predetermined angle with the first direction.

The ground via may be spaced apart from the antenna pattern along the first direction, and the ground pattern may overlap the antenna pattern along the first direction.

A distance between the feed via and a center line passing through a center of the antenna pattern and extending in a direction parallel to the first direction may be the same as a distance between the center line and the ground via.

The feed via may contact the antenna pattern.

The feed via may be spaced apart from the antenna pattern along the first direction.

The antenna device may further include a feed pattern connected to the feed via and spaced apart from the antenna pattern along the first direction to provide a feeding path to the patch antenna pattern.

A height of the ground via measured from the ground plane along the first direction may be higher than a height of the feed via.

The feed via may include a first feed via and a second feed via spaced apart from the ground via in different directions, and the ground pattern may include a first ground pattern disposed on a lateral surface of the first feed via and a second ground pattern disposed on a lateral surface of the second feed via.

A height of the ground via measured along the first direction from the ground plane may be higher than a height of the first feed via or a height of the second feed via.

The antenna pattern may include a first antenna pattern having a planar polygonal shape perpendicular to the first direction, and a plurality of second antenna patterns spaced apart from the first antenna pattern along the second direction to surround the first antenna pattern.

A distance between the ground via and the first ground pattern may be the same as a distance between the ground via and the second ground pattern.

On a plane perpendicular to the first direction, a first connection part between the first ground pattern and the ground via and a second connection part between the second ground pattern and the ground via may be disposed to be perpendicular to each other.

In another general aspect, an antenna device includes: a ground plane; a dielectric layer disposed on the ground plane; an antenna pattern disposed on the dielectric layer; a first feed via and a second feed via coupled to the antenna pattern and penetrating a portion of the dielectric layer; and a ground via connected to the ground plane and penetrating a portion of the dielectric layer, wherein a height of the ground via measured from the ground plane may be higher than one or both of a height of the first feed via and a height of the second feed via.

The antenna device may further include a first feed pattern connected to the first feed via and overlapping the antenna pattern in the first direction and a second feed pattern connected to the second feed via and overlapping the antenna pattern in the first direction, wherein the ground via may be disposed closer to a center of the antenna pattern than the first feed via and the second feed via.

The antenna pattern may include a first antenna pattern having a planar polygonal shape perpendicular to the first direction, and a plurality of second antenna patterns spaced apart from the first antenna pattern to surround the first antenna pattern.

At least a portion of the first feed pattern and at least a portion of the second feed pattern may overlap the plurality of second antenna patterns with respect to the first direction.

The antenna device may further include a plurality of sub-ground vias connected to the ground plane and penetrating at least a portion of the dielectric layer, wherein the plurality of sub-ground vias may be disposed to surround the ground via, and a height of the plurality of sub-ground vias measured from the ground plane may be higher than at least one of a height of the first feed via and a height of the second feed via.

The ground via and the plurality of sub-ground vias may be spaced apart from the antenna pattern and overlap the antenna pattern.

In another general aspect, an antenna device includes: a ground plane; a first antenna pattern that overlaps the ground plane with respect to a first direction; second antenna patterns that are coplanar with the first antenna pattern and surround portions of the first antenna pattern; a dielectric layer disposed between the ground plane and the first antenna pattern and disposed between the ground plane and the second antenna patterns; a feed via that penetrates at least a portion of the dielectric layer and overlaps one of the second antenna patterns with respect to the first direction; a ground via that penetrates at least a portion of the dielectric layer and overlaps the first antenna pattern with respect to the first direction; and a ground pattern that extends from the ground via toward the feed via in a second direction that intersects the first direction.

The antenna device may include feed pattern that extends from the feed via and overlaps the first antenna pattern and the one of the second antenna patterns with respect to the first direction.

The feed pattern may include a first pattern part connected to the feed via and extending toward the ground via along the second direction; a second pattern part connected to the first pattern part and extending toward the first antenna pattern along the first direction; and a third pattern part connected to the second pattern part and extending toward a center of the first antenna pattern along the second direction.

The first antenna pattern may include a plurality of slits, and each of the slits may extend from a side of the of first antenna pattern adjacent to a respective second antenna pattern toward a center of the first antenna pattern along the second direction.

According to the antenna device of the examples, it is possible to improve performance and to realize miniaturization.

Other features and aspects will be apparent from the following detailed description, the drawings, and the claims.

BRIEF DESCRIPTION OF THE DRAWINGS

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION

Figure 1:
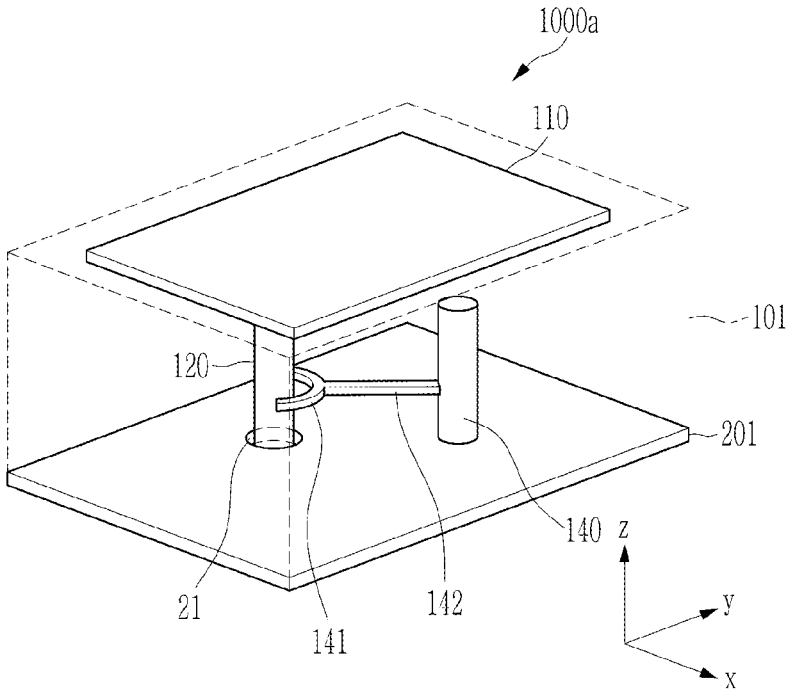
FIG. 1 illustrates a perspective view of an antenna device according to an example.

The following detailed description is provided to assist the reader in gaining a comprehensive understanding of the methods, apparatuses, and/or systems described herein. However, various changes, modifications, and equivalents of the methods, apparatuses, and/or systems described herein will be apparent after an understanding of the disclosure of this application. For example, the sequences of operations described herein are merely examples, and are not limited to those set forth herein, but may be changed as will be apparent after an understanding of the disclosure of this application, with the exception of operations necessarily occurring in a certain order. Also, descriptions of features that are known in the art may be omitted for increased clarity and conciseness.

The features described herein may be embodied in different forms, and are not to be construed as being limited to the examples described herein. Rather, the examples described herein have been provided merely to illustrate some of the many possible ways of implementing the methods, apparatuses, and/or systems described herein that will be apparent after an understanding of the disclosure of this application.

Herein, it is noted that use of the term "may" with respect to an example or embodiment, e.g., as to what an example or embodiment may include or implement, means that at least one example or embodiment exists in which such a feature is included or implemented while all examples and embodiments are not limited thereto.

Throughout the specification, when an element, such as a layer, region, or substrate, is described as being "on," "connected to," or "coupled to" another element, it may be directly "on," "connected to," or "coupled to" the other element, or there may be one or more other elements intervening therebetween. In contrast, when an element is described as being "directly on," "directly connected to," or "directly coupled to" another element, there can be no other elements intervening therebetween.

As used herein, the term "and/or" includes any one and any combination of any two or more of the associated listed items.

Although terms such as "first," "second," and "third" may be used herein to describe various members, components, regions, layers, or sections, these members, components, regions, layers, or sections are not to be limited by these terms. Rather, these terms are only used to distinguish one member, component, region, layer, or section from another member, component, region, layer, or section. Thus, a first member, component, region, layer, or section referred to in examples described herein may also be referred to as a second member, component, region, layer, or section without departing from the teachings of the examples.

Spatially relative terms such as "above," "upper," "below," and "lower" may be used herein for ease of description to describe one element's relationship to another element as shown in the figures. Such spatially relative terms are intended to encompass different orientations of the device in use or operation in addition to the orientation depicted in the figures. For example, if the device in the figures is turned over, an element described as being "above" or "upper" relative to another element will then be "below" or "lower" relative to the other element. Thus, the term "above" encompasses both the above and below orientations depending on the spatial orientation of the device. The device may also be oriented in other ways (for example, rotated 90 degrees or at other orientations), and the spatially relative terms used herein are to be interpreted accordingly.

The terminology used herein is for describing various examples only, and is not to be used to limit the disclosure. The articles "a," "an," and "the" are intended to include the plural forms as well, unless the context clearly indicates otherwise. The terms "comprises," "includes," and "has" specify the presence of stated features, numbers, operations, members, elements, and/or combinations thereof, but do not preclude the presence or addition of one or more other features, numbers, operations, members, elements, and/or combinations thereof.

Due to manufacturing techniques and/or tolerances, variations of the shapes shown in the drawings may occur. Thus, the examples described herein are not limited to the specific shapes shown in the drawings, but include changes in shape that occur during manufacturing.

The features of the examples described herein may be combined in various ways as will be apparent after an understanding of the disclosure of this application. Further, although the examples described herein have a variety of configurations, other configurations are possible as will be apparent after an understanding of the disclosure of this application.

An antenna device according to an example will be described with reference to FIG. 1 and FIG. 2. FIG. 1 illustrates a perspective view of an antenna device, and FIG. 2 illustrates a cross-sectional view of the antenna device shown in FIG. 1.

Referring to FIG. 1, an antenna device 1000*a* includes a ground plane 201 and a patch antenna pattern 110 overlapping each other with a dielectric layer 101 interposed therebetween, a feed via 120 connected to the patch antenna pattern 110, a ground via 140 connected to ground plane 201, and a ground pattern 141 extending from the ground via 140.

Figure 2:
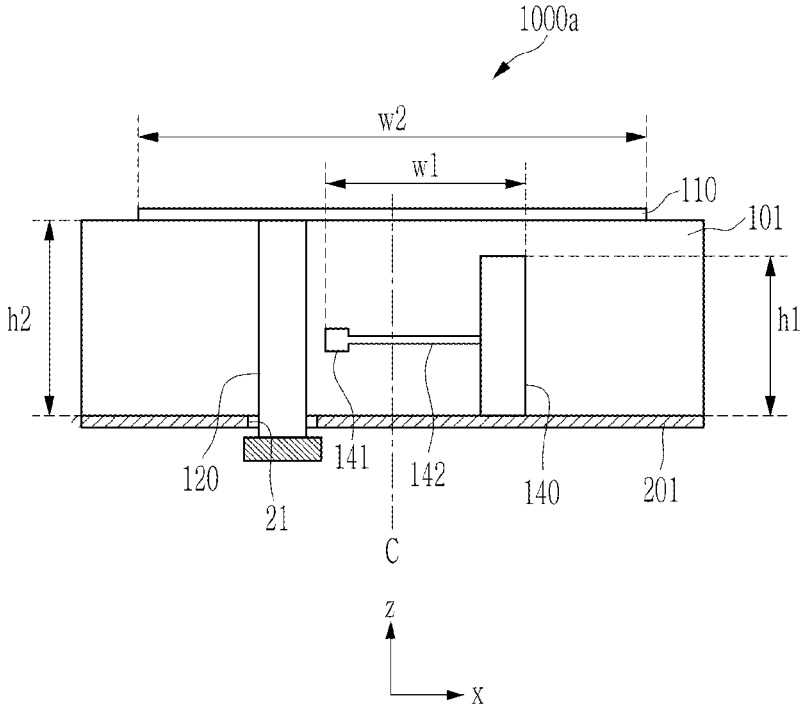
FIG. 2 illustrates a cross-sectional view of the antenna device of FIG. 1.

Referring to FIG. 2 together with FIG. 1, the ground plane 201 is positioned on a plane formed by a first direction (x) and a second direction (y) that is substantially perpendicular to the first direction (x).

The dielectric layer 101 is positioned on the ground plane 201, for example, in a third direction (z) perpendicular to the first direction (x) and the second direction (y), and the patch antenna pattern 110 is positioned on the dielectric layer 101 in the third direction (z).

A planar shape and a size of the patch antenna pattern 110 may be determined according to frequency characteristics of the antenna device 1000*a*, and may be changed according to a design of the antenna device.

The ground plane 201 has a hole 21, and the feed via 120 is formed along the third direction (z) to penetrate the hole 21 of the ground plane 201 and the dielectric layer 101 and is connected to the patch antenna pattern 110.

The ground via 140 is connected to the ground pattern 141, and is formed along the third direction (z) to penetrate a portion of the dielectric layer 101. The ground pattern 141 extends from the ground via 140 through a horizontal connection part 142 and is positioned at a side of the feed via 120.

The ground via 140 and the ground pattern 141 are disposed to overlap the patch antenna pattern 110 in a vertical direction, that is, in the third direction (z).

The ground via 140 and the ground pattern 141 do not contact the patch antenna pattern 110. That is, as shown in FIG. 2, a first height h1 of the ground via 140 measured in the third direction (z) based on the ground plane 201 is smaller than a second height h2 of the patch antenna pattern 110 measured in the third direction (z) based on the ground plane 201.

In addition, a first width w1 of the ground via 140 and the ground pattern 141 measured in a horizontal direction, that is, in the first direction (x) and the second direction (y), is narrower than a second width w2 of the patch antenna pattern 110 measured in the first direction (x) and the second direction (y).

Based on a virtual center line (C) extending in the third direction (z) past a center of the patch antenna pattern 110, a distance between the feed via 120 and the center line (C) may be substantially the same as a distance between the ground via 140 and the center line (C).

Since the feed via 120 and the ground via 140 are disposed to have the same distance from each other based on the center line (C) of the patch antenna pattern 110, it is possible to prevent a radiation pattern of the antenna from being tilted, and the radiation pattern of the antenna on a boresight is arranged at a correct position, so that the radiation pattern may not change even if it is included in an antenna array structure including a plurality of antennas.

Although not illustrated, an electronic element connected to the feed via 120 to transmit an electrical signal may be disposed below the ground plane 201, that is, in a direction opposite to the third direction (z).

When an electrical signal is transmitted from the electronic element to the feed via 120, the electrical signal is transmitted through the feed via 120 to the patch antenna pattern 110 coupled with the feed via 120, and the patch antenna pattern 110 may transmit and receive an RF signal by coupling with the ground plane 201.

In this case, coupling is also made between the feed via 120 and the ground via 140 and ground pattern 141 located at a side of the feed via 120, and accordingly, a gain and bandwidth of the patch antenna pattern 110 may be improved.

In addition, since the ground via 140, the ground pattern 141, and the horizontal connection part 142 are disposed to overlap the patch antenna pattern 110 in a vertical direction, that is, in the third direction (z), and they are disposed in an area occupied by the patch antenna pattern 110, unlike the case in which the ground via and the ground pattern are formed at the side of the antenna patch, it is possible to prevent the antenna device from being enlarged for the arrangement of the ground via and the ground pattern.

In addition, since the ground via 140 and the ground pattern 141 act as a moving path of unnecessary frequency components that may occur around the patch antenna pattern 110, the unnecessary frequency components may be transmitted to the ground plane 201 through the ground pattern 141, the horizontal connection part 142, and the ground via 140, and thus, it is possible to prevent performance degradation of the antenna device according to a noise frequency component.

As such, since the antenna device 1000*a* includes the ground via 140 and the ground pattern 141 positioned at the side of the feed via 120, it is possible to improve the gain and bandwidth of the patch antenna pattern 110 by inducing additional coupling, and since the ground via 140 and the ground pattern 141 are arranged to overlap the patch antenna pattern 110 between the ground plane 201 and the patch antenna pattern 110 in the vertical direction, it is possible to prevent the antenna device from becoming large for the arrangement of the ground via and the ground pattern.

Therefore, the antenna device may be miniaturized while improving the performance of the antenna device.

Figure 3:
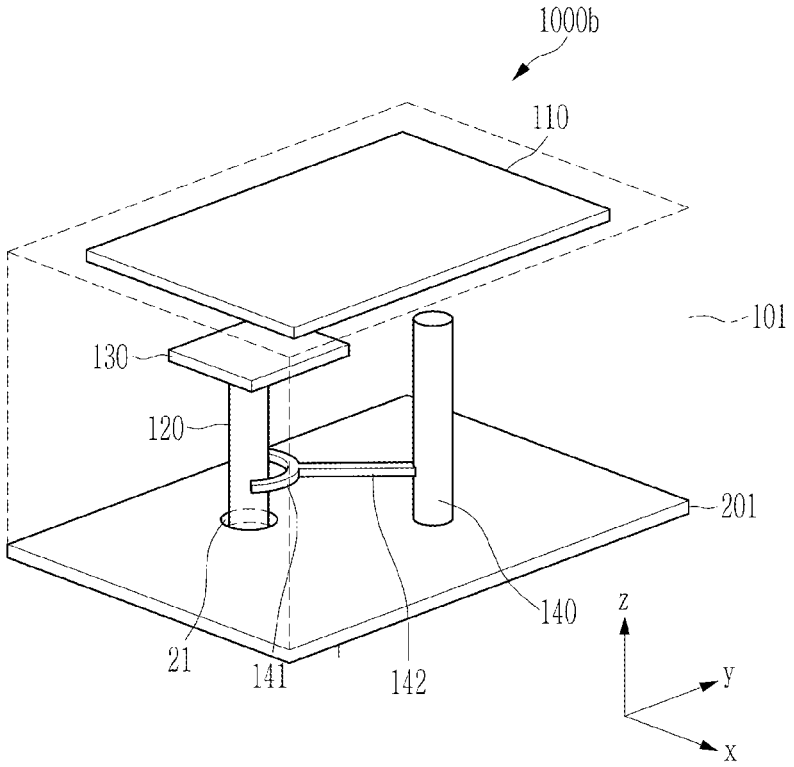
FIG. 3 illustrates a perspective view of an antenna device according to an example.

Now, an antenna device according to another example will be described with reference to FIG. 3 and FIG. 4. FIG. 3 illustrates a perspective view of an antenna device according to another example, and FIG. 4 illustrates a cross-sectional view of the antenna device of FIG. 3.

Figure 4:
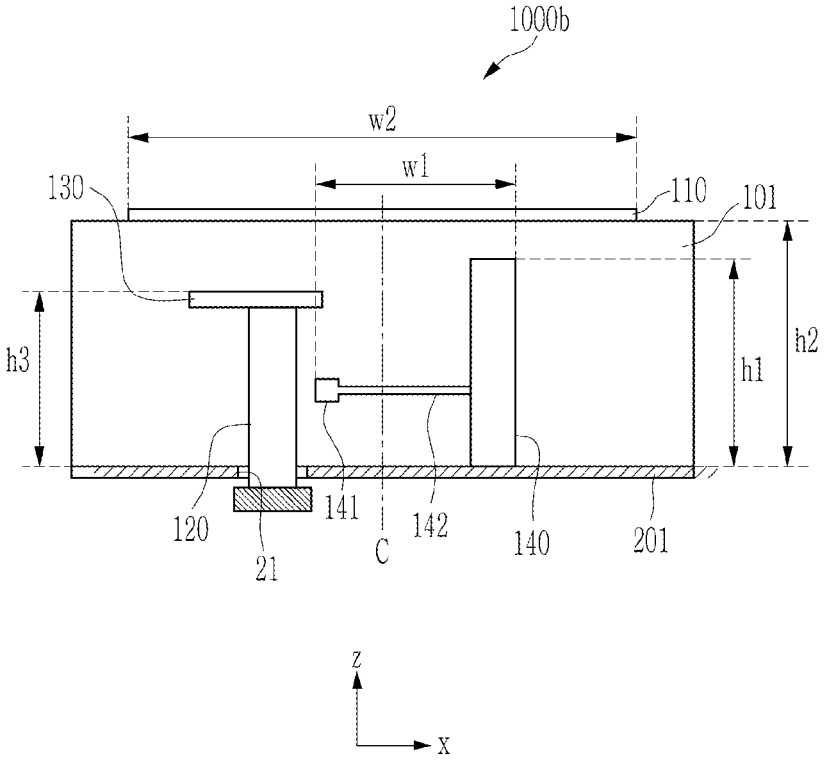
FIG. 4 illustrates a cross-sectional view of the antenna device of FIG. 3.

Reference to FIG. 3 and FIG. 4, the antenna device 1000*b* may share some features with the antenna device 1000*a* described with reference to FIG. 1 and FIG. 2 above. A detailed description of the same constituent elements will be omitted.

The antenna device 1000*b* includes: a ground plane 201 and a patch antenna pattern 110 overlapping each other in the vertical direction, for example, in the third direction (z), with a dielectric layer 101 interposed therebetween; a feed via 120 that is formed to penetrate a portion of the ground plane 201 and the dielectric layer 101 and is electrically connected to the patch antenna pattern 110; a feed pattern 130 extending from the feed via 120; a ground via 140 extending from the ground plane 201 and formed to penetrate the dielectric layer 101; and a ground pattern 141 extending from the ground via 140 and located at a side of the feed via 120.

The dielectric layer 101 is located on the ground plane 201, that is, in the third direction (z), and the patch antenna pattern 110 is located on the dielectric layer 101, that is, in the third direction (z).

A planar shape and a size of the patch antenna pattern 110 may be determined according to frequency characteristics of the antenna device 1000*b*, and may be changed according to a design of the antenna device.

The ground plane 201 has a hole 21, and the feed via 120 is formed along the third direction (z) to penetrate the hole 21 of the ground plane 201 and a portion of the dielectric layer 101 and is connected to the feed pattern 130, and the feed pattern 130 is not directly connected to the patch antenna pattern 110. That is, the feed via 120 and the feed pattern 130 are disposed to be spaced apart from the patch antenna pattern 110 along the third direction (z).

The ground via 140 is connected to the ground plane 201, and is formed along the third direction (z) to penetrate a portion of the dielectric layer 101. The ground pattern 141 extends from the ground via 140 through a horizontal connection part 142 and is positioned at a side of the feed via 120.

The ground via 140, the ground pattern 141, and the horizontal connection part 142 are disposed to overlap the patch antenna pattern 110 in the vertical direction, that is, in the third direction (z).

The ground via 140 and the ground pattern 141 do not contact the patch antenna pattern 110.

A first height h1 of the ground via 140 measured in the third direction (z) based on the ground plane 201 is smaller than a second height h2 of the patch antenna pattern 110 measured in the third direction (z) based on the ground plane 201. In addition, a third height h3 of the feed via 120 and the feed pattern 130 measured in the third direction (z) based on the ground plane 201 is smaller than a second height h2 of the patch antenna pattern 110 measured in the third direction (z) based on the ground plane 201.

In addition, a first width w1 of the ground via 140 and the ground pattern 141 measured in a horizontal direction, that is, in the first direction (x) and the second direction (y), is narrower than a second width w2 of the patch antenna pattern 110 measured in the first direction (x) and the second direction (y).

Based on a virtual center line (C) extending in the third direction (z) past a center of the patch antenna pattern 110, a distance between the feed via 120 and the center line (C) may be substantially the same as a distance between the ground via 140 and the center line (C).

Since the feed via 120 and the ground via 140 are disposed to have the same distance from each other based on the center line (C) of the patch antenna pattern 110, it is possible to prevent a radiation pattern of the antenna from being tilted, and the radiation pattern of the antenna on a boresight is arranged at a correct position, so that the radiation pattern may not change even if it is included in an antenna array structure including a plurality of antennas.

Although not illustrated, an electronic element connected to the feed via 120 to transmit an electrical signal may be disposed below the ground plane 201, that is, in a direction opposite to the third direction (z).

When the electrical signal is transmitted from the electronic element to the feed via 120, the feed pattern 130 and the patch antenna pattern 110 connected to the feed via 120 to which the electrical signal is applied are coupled, so that the patch antenna pattern 110 is fed by coupling feeding. The fed patch antenna pattern 110 may transmit and receive an RF signal by coupling with the ground plane 201.

In this case, coupling is also formed between the ground via 140 and the ground pattern 141 located at the side of the feed via 120 and the feed via 120, thus the gain and bandwidth of the patch antenna pattern 110 may be improved.

In addition, since the ground via 140 and the ground pattern 141 are disposed to overlap the patch antenna pattern 110 in a vertical direction, that is, in the third direction (z) and they are disposed in an area occupied by the patch antenna pattern 110, unlike the case in which the ground via and the ground pattern are formed at the side of the antenna patch, it is possible to prevent the antenna device from being enlarged for the arrangement of the ground via and the ground pattern.

In addition, since the ground via 140 and the ground pattern 141 act as a moving path of unnecessary frequency components that may occur around the patch antenna pattern 110, the unnecessary frequency components may be transmitted to the ground plane 201 through the ground via 140 and the ground pattern 141, and thus, it is possible to prevent performance degradation of the antenna device according to a noise frequency component.

As such, since the antenna device 1000*b* includes the ground via 140 and the ground pattern 141 positioned at the side of the feed via 120, it is possible to improve the gain and bandwidth of the patch antenna pattern 110 by inducing additional coupling, and since the ground via 140 and the ground pattern 141 are arranged to overlap the patch antenna pattern 110 between the ground plane 201 and the patch antenna pattern 110 in the vertical direction, it is possible to prevent the antenna device from becoming large for the arrangement of the ground via and the ground pattern.

Therefore, the antenna device may be miniaturized while improving the performance of the antenna device.

Many features of the antenna device according to the above-described examples are all applicable to the disclosed antenna devices.

Figure 5:
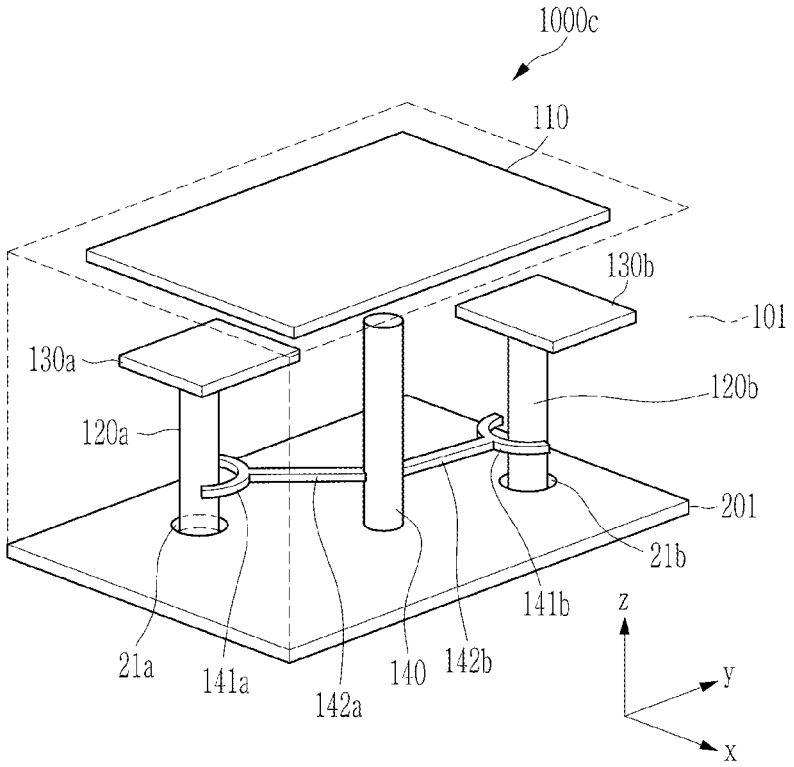
FIG. 5 illustrates a perspective view of an antenna device according to an example.

Hereinafter, an antenna device 1000*c* according to another example will be described with reference to FIG. 5 and FIG. 6. FIG. 5 illustrates a perspective view of an antenna device according to another example, and FIG. 6 illustrates a cross-sectional view of the antenna device of FIG. 5.

Figure 6:
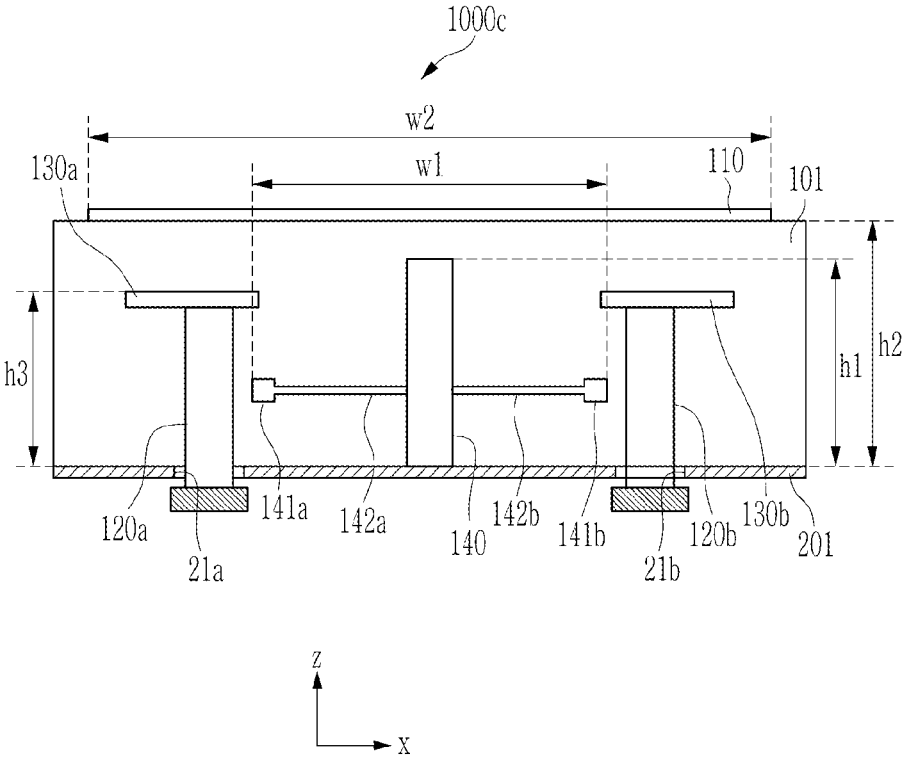
FIG. 6 illustrates a cross-sectional view of the antenna device of FIG. 5.

Reference to FIG. 5 and FIG. 6, the antenna device 1000*c* may have some similar features to the antenna device 1000*b* described above with reference to FIG. 3 and FIG. 4. A detailed description of the same constituent elements will be omitted.

The antenna device 1000*c* includes: a ground plane 201 and a patch antenna pattern 110 overlapping each other in the vertical direction, for example, in the third direction (z), with a dielectric layer 101 interposed therebetween; a first feed via 120*a* and a second feed via 120*b* that are formed to penetrate the ground plane 201 and a portion of the dielectric layer 101; a first feed pattern 130*a* and a second feed pattern 130*b* extending from the first feed via 120*a* and the second feed via 120*b* and overlapping the patch antenna pattern 110 in the vertical direction, for example, in the third direction (z); a ground via 140 extending from the ground plane 201 and formed to penetrate the dielectric layer 101; and a first ground pattern 141*a* and a second ground pattern 141*b* extending from the ground via 140 through a first horizontal connection part 142*a* and a second horizontal connection part 142*b* to be located at sides of the first feed via 120*a* and the second feed via 120*b*.

The dielectric layer 101 is located on the ground plane 201, that is, in the third direction (z), and the patch antenna pattern 110 is located on the dielectric layer 101, that is, in the third direction (z).

A planar shape and a size of the patch antenna pattern 110 may be determined according to frequency characteristics of the antenna device 1000*c*, and may be changed according to a design of the antenna device.

The ground plane 201 has a first hole 21*a* and a second hole 21*b*, and the first feed via 120*a* and the second feed via 120*b* are formed along the third direction (z) to penetrate the first hole 21*a* and the second hole 21*b* of the ground plane 201 and a portion of the dielectric layer 101 and are not directly connected to the patch antenna pattern 110. The first feed pattern 130*a* and the second feed pattern 130*b* connected to the first feed via 120*a* and the second feed via 120*b* are also not directly connected to the patch antenna pattern 110.

That is, the first feed via 120*a* and the second feed via 120*b* and the first feed pattern 130*a* and the second feed pattern 130*b* are arranged to be spaced apart from the patch antenna pattern 110 along the third direction (z), and they vertically overlap the patch antenna pattern 110.

The ground via 140 is connected to the ground plane 201 and is formed along the third direction (z) to penetrate a portion of the dielectric layer 101. The first ground pattern 141*a* and the second ground pattern 141*b* extend from the ground via 140 through the first horizontal connection part 142*a* and the second horizontal connection part 142*b* to be located at sides of the first feed via 120*a* and the second feed via 120*b*.

The ground via 140, the first ground pattern 141*a*, and the second ground pattern 141*b* are arranged to overlap the patch antenna pattern 110 in the vertical direction, that is, in the third direction (z).

The ground via 140, the first ground pattern 141*a*, and the second ground pattern 141*b* do not contact the patch antenna pattern 110.

A first height h1 of the ground via 140 measured in the third direction (z) based on the ground plane 201 is smaller than a second height h2 of the patch antenna pattern 110 measured in the third direction (z) based on the ground plane 201. In addition, a third height h3 of the first feed via 120*a* and the second feed via 120*b* and the first feed pattern 130*a* and the second feed pattern 130*b* measured in the third direction (z) based on the ground plane 201 is smaller than the second height h2 of the patch antenna pattern 110 and the first height h1 of the ground via 140 measured in the third direction (z) based on the ground plane 201.

In addition, a first width w1 of the ground via 140 and the first ground pattern 141*a* and the second ground pattern 141*b* measured along the horizontal direction, that is, along the first direction (x) or the second direction (y), is narrower than a second width w2 of the patch antenna pattern 110 measured in the first direction (x) or the second direction (y).

An electronic element connected to the first feed via 120*a* and the second feed via 120*b* to transmit an electrical signal may be disposed below the ground plane 201, that is, in a direction opposite to the third direction (z).

When the electrical signal is transmitted from the electronic element to the first feed via 120*a* and the second feed via 120*b*, the first feed pattern 130*a* and the second feed pattern 130*b* and the patch antenna pattern 110 connected to the first feed via 120*a* and the second feed via 120*b* to which the electrical signal is applied are coupled, so that the patch antenna pattern 110 is fed by coupling feeding. The fed patch antenna pattern 110 may transmit and receive an RF signal by coupling with the ground plane 201.

The patch antenna pattern 110 is fed through two feed vias that are the first feed via 120*a* and the second feed via 120*b*, and a first surface current generated in the patch antenna pattern 110 by the first feed via 120*a* and the first feed pattern 130*a* and a second surface current generated in the antenna pattern 110 by the second feed via 120*b* and the second feed pattern 130*b* may be different, and they may flow in different directions. The patch antenna pattern 110 may transmit and receive a first RF signal caused by the first surface current generated by the first feed via 120*a* and the first feed pattern 130*a* and a second RF signal caused by the second surface current generated by the second feed via 120*b* and the second feed pattern 130*b*.

The ground via 140 may be disposed to overlap a position of the patch antenna pattern 110 at which a sum of the first surface current generated in the patch antenna pattern 110 by the first feed via 120*a* and the first feed pattern 130*a* and the second surface current generated in the patch antenna pattern 110 by the second feed via 120*b* and the second feed pattern 130*b* is zero. For example, the ground via 140 may be positioned to overlap a central portion of the patch antenna pattern 110. In addition, a distance between the first feed via 120*a* and the ground via 140 may be the same as a distance between the second feed via 120*b* and the ground via 140, and the first horizontal connection part 142*a* between the ground via 140 and the first ground pattern 141*a* and the second horizontal connection part 142*b* between the ground via 140 and the second ground pattern 141*b* may be disposed to be perpendicular to each other.

As such, by disposing the ground via 140 to overlap the central portion of the patch antenna pattern 110, an influence between the first feed via 120*a* and the second feed via 120*b* can be reduced to increase an isolation degree, and accordingly, it is possible to reduce mutual interference between the first RF signal caused by the first surface current generated by the first feed via 120*a* and the first feed pattern 130*a* and the second RF signal caused by the second surface current generated by the second feed via 120*b* and the second feed pattern 130*b*.

As described above, the patch antenna pattern 110 may transmit and receive the first RF signal caused by the first surface current generated by the first feed via 120*a* and the first feed pattern 130*a* and the second RF signal caused by the second surface current generated by the second feed via 120*b* and the second feed pattern 130*b*, and in this case, coupling is also made between the first ground pattern 141*a* and the second ground pattern 141*b* located at the sides of the first feed via 120*a* and the second feed via 120*b* and the first feed via 120*a* and the second feed 120*b*, and thus, the gain and bandwidth of the patch antenna pattern 110 may be improved.

In addition, since the ground via 140, the first ground pattern 141*a*, and the second ground pattern 141*b* are disposed to overlap the patch antenna pattern 110 in a vertical direction, that is, in the third direction (z) and they are disposed in an area occupied by the patch antenna pattern 110, unlike the case in which the ground via and the ground pattern are formed at the side of the antenna patch, it is possible to prevent the antenna device from being enlarged for the arrangement of the ground via and the ground pattern.

In addition, an influence between the first feed via 120*a* and the second feed via 120*b* may be reduced through the ground via 140 to increase an isolation degree, and thus it is possible to reduce mutual interference between the first RF signal caused by the first surface current generated by the first feed via 120*a* and the first feed pattern 130*a* and the second RF signal caused by the second surface current generated by the second feed via 120*b* and the second feed pattern 130*b*.

In addition, since the ground via 140 and the first ground pattern 141*a* and the second ground pattern 141*b* act as a moving path of unnecessary frequency components that may occur around the patch antenna pattern 110, the unnecessary frequency components may be transmitted to the ground plane 201 through the ground via 140, the first ground pattern 141*a*, and the second ground pattern 141*b*, and thus, it is possible to prevent performance degradation of the antenna device according to a noise frequency component.

As such, since the antenna device 1000*c* includes the ground via 140, the first ground pattern 141*a*, and the second ground pattern 141*b* positioned at the sides of the first feed via 120*a* and the second feed via 120*b*, it is possible to improve the gain and bandwidth of the patch antenna pattern 110 by inducing additional coupling, and since the ground via 140, the first ground pattern 141*a*, and the second ground pattern 141*b* are arranged to overlap the patch antenna pattern 110 between the ground plane 201 and the patch antenna pattern 110 in the vertical direction, it is possible to prevent the antenna device from becoming large for the arrangement of the ground via and the ground pattern.

Therefore, the antenna device may be miniaturized while improving the performance of the antenna device.

Figure 7A:
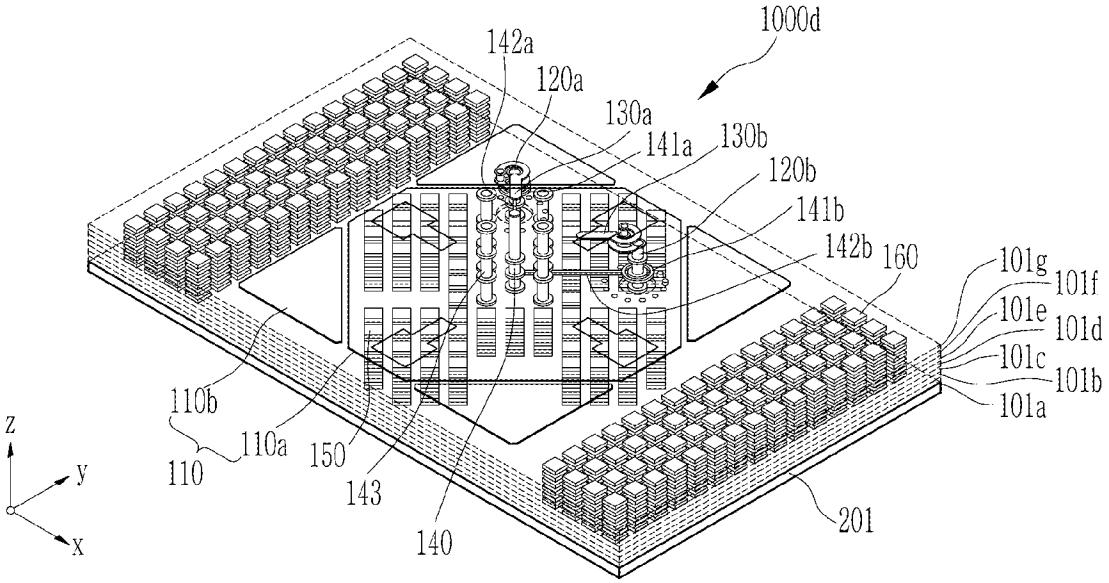
FIG. 7A and FIG. 7B illustrate perspective views of an antenna device according to an example.
Figure 7B:
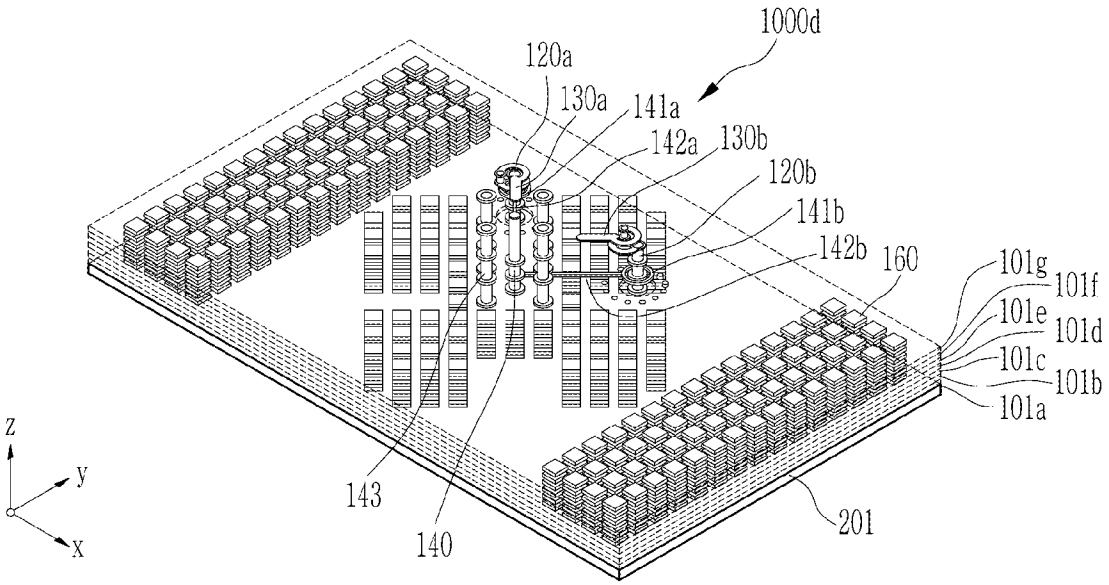
Figure 8A:
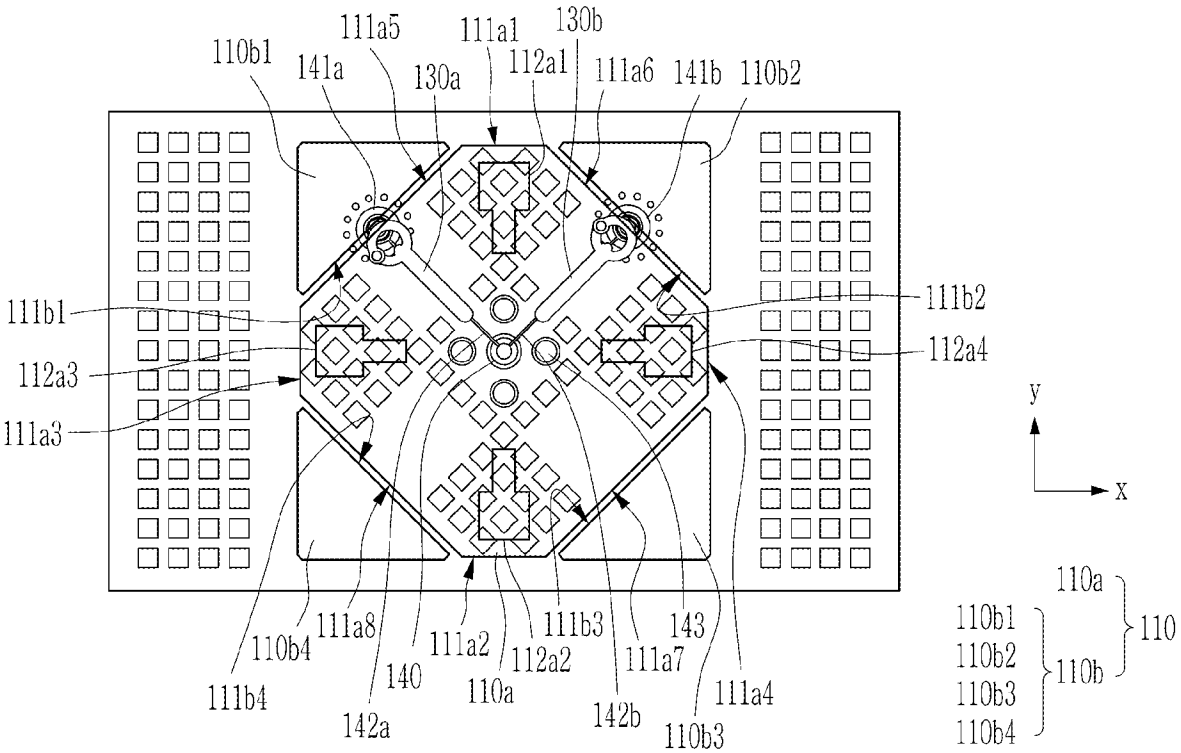
FIG. 8A and FIG. 8B illustrate top plan views of an antenna device according to an example.
Figure 8B:
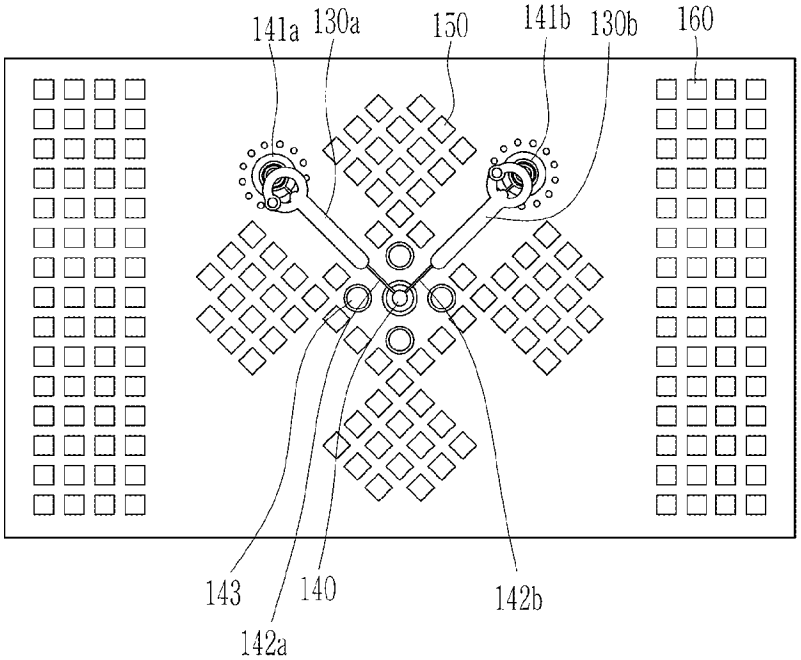

Hereinafter, an antenna device 1000*d* according to another example will be described with reference to FIG. 7A, FIG. 7B, FIG. 8A, and FIG. 8B. FIG. 7A and FIG. 7B illustrate perspective views of an antenna device 1000*d*, where FIG. 7B illustrates a structure in which a patch antenna pattern is omitted in the antenna device of FIG. 7A. FIG. 8A and FIG. 8B illustrate top plan views of an antenna device, where FIG. 8B illustrates a structure in which a patch antenna pattern is omitted in the antenna device of FIG. 8A.

Referring to FIG. 7A, FIG. 7B, FIG. 8A, and FIG. 8B, an antenna device 1000*d* includes: a ground plane 201; a patch antenna pattern 110 vertically overlapping the ground plane 201 with a plurality of dielectric layers 101*a*, 101*b*, 101*c*, 101*d*, 101*e*, 101*f*, and 101*g* interposed therebetween; a first feed via 120*a* and a second feed via 120*b* overlapping the patch antenna pattern 110 and penetrating some of the plurality of dielectric layers 101*a*, 101*b*, 101*c*, 101*d*, 101*e*, 101*f*, and 101*g*; a first feed pattern 130*a* and a second feed pattern 130*b* connected to the first feed via 120*a* and the second feed via 120*b*; a ground via 140 connected to ground plane 201; a first ground pattern 141*a* and a second ground pattern 141*b* extending from the ground via 140 through a first horizontal connection part 142*a* and a second horizontal connection part 142*b* to be located at sides of the first feed via 120*a* and the second feed via 120*b*; and a plurality of first dummy patterns 150 and a plurality of second dummy patterns 160 located around the feed vias 120*a* and 120*b* and the feed patterns 130*a* and 130*b*.

The patch antenna pattern 110 overlaps the ground plane 201 along the vertical direction, that is, along the third direction (z), with the plurality of dielectric layers 101*a*, 101*b*, 101*c*, 101*d*, 101*e*, 101*f*, and 101*g* interposed therebetween. That is, the ground plane 201 may be positioned below the first dielectric layer 101*a* that is positioned at the bottom of the plurality of dielectric layers 101*a*, 101*b*, 101*c*, 101*d*, 101*e*, 101*f*, and 101*g* along the third direction (z), and the patch antenna pattern 110 may be positioned above the seventh dielectric layer 101*g* that is positioned at the top of the plurality of dielectric layers 101*a*, 101*b*, 101*c*, 101*d*, 101*e*, 101*f*, and 101*g* along the third direction (z).

The patch antenna pattern 110 includes a first patch antenna pattern 110*a* positioned at a center of the antenna device and a plurality of second patch antenna patterns 110*b* positioned around the first patch antenna pattern 110*a*.

The first patch antenna pattern 110*a* and the plurality of second patch antenna patterns 110*b* may have a polygonal planar shape.

According to the illustrated example, the first patch antenna pattern 110*a* may have a planar shape of an octagon in a plan view formed by the first direction (x) and the second direction (y), and the octagon has a first side 111*a*1 and a second side 111*a*2 parallel to and spaced from each other in the first direction (x), a third side 111*a*3 and a fourth side 111*a*4 parallel to the second direction (y), and a fifth side 111*a*5, a sixth side 111*a*6, a seventh side 111*a*7, and an eighth side 111*a*8 extending to form a diagonal line with the first direction (x) and the second direction (y). For example, the fifth side 111*a*5, the sixth side 111*a*6, the seventh side 111*a*7, and the eighth side 111*a*8 may form an angle of about 45 degrees or about 135 degrees with the first direction (x) and the second direction (y).

The plurality of second patch antenna patterns 110*b* positioned around the first patch antenna pattern 110*a* includes a plurality of sub-patch antenna patterns 110*b*1, 110*b*2, 110*b*3, and 110*b*4 disposed adjacent to the fifth side 111*a*5, the sixth side 111*a*6, the seventh side 111*a*7, and the eighth side 111*a*8 of the first patch antenna pattern 110*a*.

The plurality of sub-patch antenna patterns 110*b*1, 110*b*2, 110*b*3, and 110*b*4 may have a right-angled triangular shape, respectively, in a plan view formed by the first direction (x)

and the second direction (y), and hypotenuses 111*b*1, 111*b*2, 111*b*3, and 111*b*4 of four sub-patch antenna patterns 110*b*1, 110*b*2, 110*b*3, and 110*b*4 having the right-angled triangular shape are spaced apart from the fifth side 111*a*5, the sixth side 111*a*6, the seventh side 111*a*7, and the eighth side 111*a*8 of the first patch antenna pattern 110*a* to face each other.

The first patch antenna pattern 110*a* and the plurality of second patch antenna patterns 110*b* together may substantially form a quadrangular planar shape. For example, a width of the patch antenna pattern 110 in the second direction (y) may be about 3.5 mm.

The first patch antenna pattern 110*a* has a plurality of slits 112*a*1, 112*a*2, 112*a*3, and 112*a*4, and the plurality of slits 112*a*1, 112*a*2, 112*a*3, and 112*a*4 may be formed at positions adjacent to a first side 111*a*1, a second side 111*a*2, a third side 111*a*3, and a fourth side 111*a*4 of the first patch antenna pattern 110*a*.

The plurality of slits 112*a*1, 112*a*2, 112*a*3, and 112*a*4 may have a combined shape of a square adjacent to the first side 111*a*1, the second side 111*a*2, the third side 111*a*3, and the fourth side 111*a*4 of the first patch antenna pattern 110*a* and a rectangular shape having a narrow width extending therefrom.

The planar shape of the first patch antenna pattern 110*a* and the plurality of second patch antenna patterns 110*b* described above is an example, and the planar shape of the first patch antenna pattern 110*a* and the plurality of second patch antenna patterns 110*b* is not limited thereto, and may be modified according to the design of the antenna device 1000*d*.

The ground plane 201 may have a first hole 21*a* and a second hole 21*b*, and the first feed via 120*a* and the second feed via 120*b* may be formed to penetrate the first hole 21*a* and the second hole 21*b* of the ground plane 201, and some of the plurality of dielectric layers 101*a*, 101*b*, 101*c*, 101*d*, 101*e*, 101*f*, and 101*g*, for example, the first dielectric layer 101*a*, the second dielectric layer 101*b*, and the third dielectric layer 101*c*.

The first feed pattern 130*a* and the second feed pattern 130*b* may be disposed to be connected to the first feed via 120*a* and the second feed via 120*b* and to be adjacent to the fifth side 111*a*5 and the sixth side 111*a*6 of the first patch antenna pattern 110*a*. In addition, the first feed pattern 130*a* and the second feed pattern 130*b* may be disposed to overlap the first sub-patch antenna pattern 110*b*1 and the second sub-patch antenna pattern 110*b*2 adjacent to the fifth side 111*a*5 and the sixth side 111*a*6 of the first patch antenna pattern 110*a* in the vertical direction, that is, the third direction (z).

The ground via 140 connected to the ground plane 201 may be formed to penetrate some of the plurality of dielectric layers 101*a*, 101*b*, 101*c*, 101*d*, 101*e*, 101*f*, and 101*g*, for example, the first dielectric layer 101*a*, the second dielectric layer 101*b*, the third dielectric layer 101*c*, the fourth dielectric layer 101*d*, the fifth dielectric layer 101*e*, and the sixth dielectric layer 101*f*.

The first ground pattern 141*a* and the second ground pattern 141*b* may extend from the ground via 140 through the first horizontal connection part 142*a* and the second horizontal connection part 142*b* to be positioned on the second dielectric layer 101*b*. The first ground pattern 141*a* and the second ground pattern 141*b* may be disposed on the second dielectric layer 101*b* to surround respective sides of the first feed via 120*a* and the second feed via 120*b*. The first ground pattern 141*a* and the second ground pattern 141*b* are disposed to be spaced apart from the first feed via 120*a* and the second feed via 120*b* on the second dielectric layer 101*b*, and to overlap the patch antenna pattern 110 along the third direction (z).

A height of the ground via 140 may be greater than heights of the first feed via 120*a*, the second feed via 120*b*, the first feed pattern 130*a*, and the second feed pattern 130*b* along the third direction (z) with respect to the ground plane 201, and it may be lower than a height of the patch antenna pattern 110. Therefore, the ground via 140 is not connected to the patch antenna pattern 110, but is disposed to overlap the patch antenna pattern 110 along the third direction (z).

As such, since the ground via 140, the first ground pattern 141*a*, and the second ground pattern 141*b* are disposed to overlap the patch antenna pattern 110 in a vertical direction, that is, in the third direction (z), unlike the case in which the ground via and the ground pattern are formed at the side of the antenna patch, it is possible to prevent the antenna device from being enlarged for the arrangement of the ground via and the ground pattern.

The plurality of first dummy patterns 150 may be disposed around the first feed via 120*a* and the second feed via 120*b* and the first feed pattern 130*a* and the second feed pattern 130*b*, and may be disposed to overlap the patch antenna pattern 110 in the vertical direction, that is, the third direction (z). The plurality of first dummy patterns 150 may be respectively positioned on the first dielectric layer 101*a*, the second dielectric layer 101*b*, the third dielectric layer 101*c*, the fourth dielectric layer 101*d*, the fifth dielectric layer 101*e*, and the sixth dielectric layer 101*f* of the plurality of dielectric layers 101*a*, 101*b*, 101*c*, 101*d*, 101*e*, 101*f*, and 101*g*, and they may have shapes in which patterns of a plurality of polygonal shapes are overlapped along the third direction (z) perpendicular to a surface of the patch antenna pattern 110. For example, the plurality of polygonal shapes may be shapes in which six quadrangular patterns respectively disposed on the first dielectric layer 101*a*, the second dielectric layer 101*b*, the third dielectric layer 101*c*, the fourth dielectric layer 101*d*, the fifth dielectric layer 101*e*, and the sixth dielectric layer 101*f* are overlapped along the third direction (z).

The plurality of first dummy patterns 150 may fill spaces between the plurality of dielectric layers 101*a*, 101*b*, 101*c*, 101*d*, 101*e*, 101*f*, and 101*g* between the ground plane 201 and the patch antenna pattern 110 to allow the patch antenna pattern 110 to be well maintained on the plurality of dielectric layers 101*a*, 101*b*, 101*c*, 101*d*, 101*e*, 101*f*, and 101*g* without change of the shape thereof, and may fill spaces between the plurality of dielectric layers 101*a*, 101*b*, 101*c*, 101*d*, 101*e*, 101*f*, and 101*g* between the ground plane 201 and the patch antenna pattern 110 to allow a current fed through the first feed pattern 130*a* and the second feed pattern 130*b* to be mainly fed to the patch antenna pattern 110 without being lost through the surrounding dielectric layer.

The plurality of second dummy patterns 160 do not overlap the patch antenna pattern 110 in the vertical direction, that is, in the third direction (z), and may be positioned at both sides of the patch antenna pattern 110 along the first direction (x); the plurality of second dummy patterns 160 may be respectively positioned on the first dielectric layer 101*a*, the second dielectric layer 101*b*, the third dielectric layer 101*c*, the fourth dielectric layer 101*d*, the fifth dielectric layer 101*e*, and the sixth dielectric layer 101*f* of the plurality of dielectric layers 101*a*, 101*b*, 101*c*, 101*d*, 101*e*, 101*f*, and 101*g*; and the plurality of second dummy patterns 160 may have shapes in which patterns of a plurality of polygonal shapes are overlapped along the third direction (z)

perpendicular to the surface of the patch antenna pattern 110. For example, the plurality of polygonal shapes may be shapes in which six quadrangular patterns respectively disposed on the first dielectric layer 101*a*, the second dielectric layer 101*b*, the third dielectric layer 101*c*, the fourth dielectric layer 101*d*, the fifth dielectric layer 101*e*, and the sixth dielectric layer 101*f* are overlapped along the third direction (z).

The plurality of second dummy patterns 160 may prevent heights of the plurality of dielectric layers 101*a*, 101*b*, 101*c*, 101*d*, 101*e*, 101*f*, and 101*g* positioned around the patch antenna pattern 110 to be lowered around the patch antenna pattern 110, and may fill a peripheral area of the patch antenna pattern 110 to prevent a current flowing through an edge of the patch antenna pattern 110 from being lost around the patch antenna pattern 110, thus it is possible to allow a current fed through the first feed pattern 130*a* and the second feed pattern 130*b* to be mainly fed to the patch antenna pattern 110 without being lost through the surrounding dielectric layer.

Figure 9:
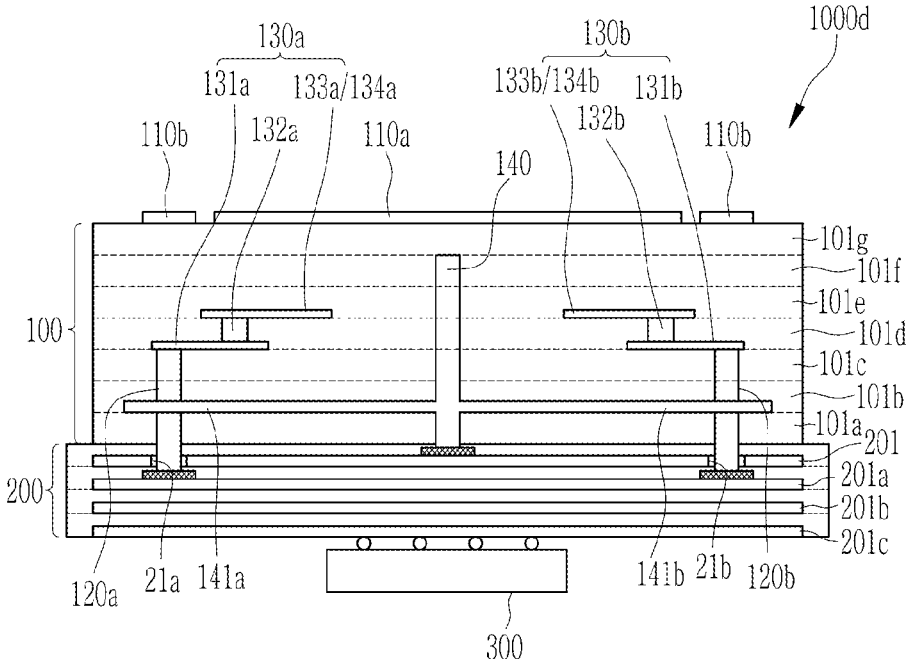
FIG. 9 illustrates a cross-sectional view of the antenna device of FIG. 7A and FIG. 8A.
Figure 10:
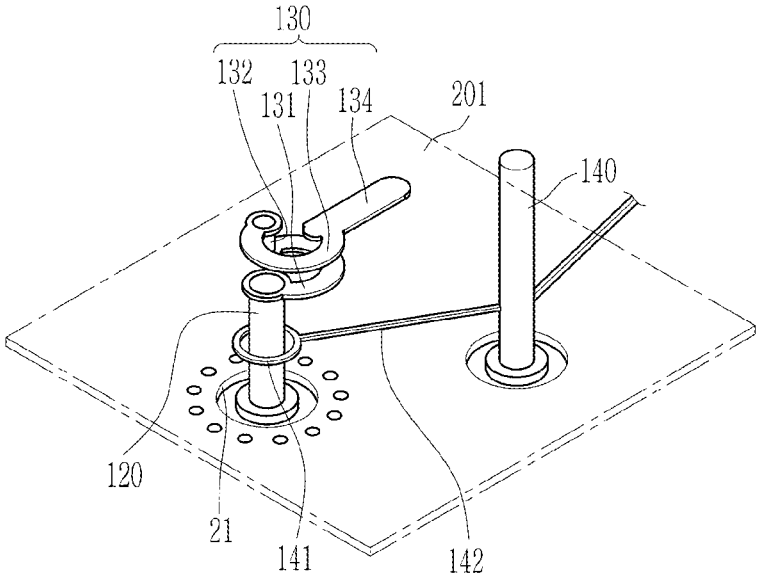
FIG. 10 illustrates a perspective view of a portion of the antenna device of FIG. 7A and FIG. 8A.
Figure 11:
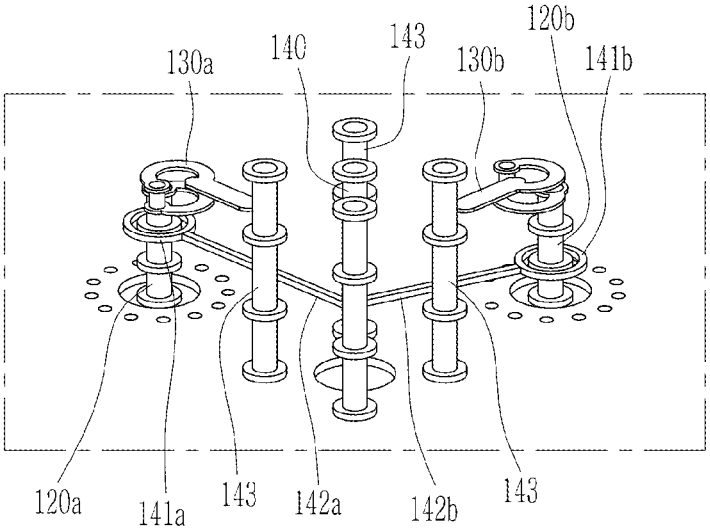
FIG. 11 illustrates a perspective view of a portion of the antenna device of FIG. 7A and FIG. 8A.
Figure 12A:
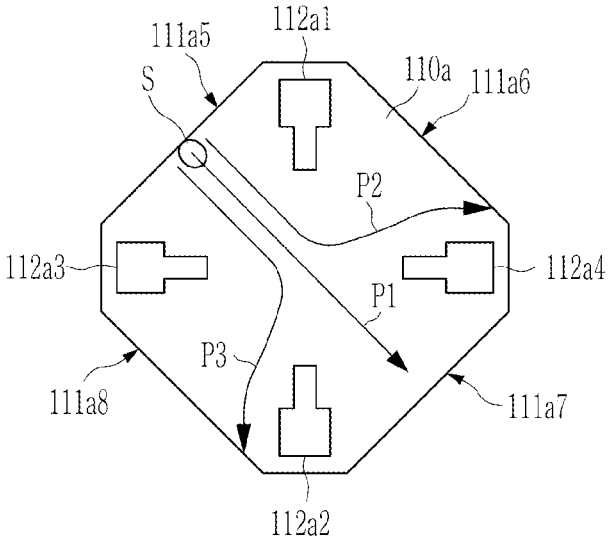
FIG. 12A and FIG. 12B illustrate schematic views of a current path according to an example.
Figure 12B:
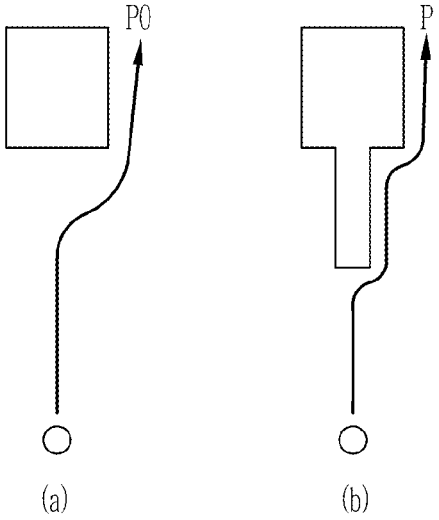

Hereinafter, the antenna device 1000*d* will be described in more detail with reference to FIG. 9 to FIG. 11 and FIG. 12A and FIG. 12B together with FIG. 7A, FIG. 7B, FIG. 8A, and FIG. 8B. FIG. 9 illustrates a cross-sectional view of the antenna device 1000*d*, FIG. 10 illustrates a perspective view of a portion of the antenna device, and FIG. 11 illustrates a perspective view of a portion of the antenna device. FIG. 12A and FIG. 12B illustrate schematic views of a current path according to an example.

First, referring to FIG. 9, the antenna device 1000*d* further includes a connection part 200 positioned below the plurality of dielectric layers 101*a*, 101*b*, 101*c*, 101*d*, 101*e*, 101*f*, and 101*g* along the third direction (z), and an electronic element 300 positioned below the connection part 200.

The connection part 200 may be a printed circuit board (PCB), and may be flexible.

The connection part 200 may include a ground plane 201 and a plurality of metal layers 201*a*, 201*b*, and 201*c*, and the ground via 140 may be connected to the ground plane 201.

The first feed via 120*a* and the second feed via 120*b* may be formed to penetrate the first hole 21*a* and the second hole 21*b* formed in the ground plane 201 to be connected to one of the plurality of metal layers 201*a*, 201*b*, and 201*c* of the connection part 200, and they may receive an electrical signal transmitted from the electronic element 300 connected below the connection part 200.

When an electrical signal is applied to the first feed via 120*a* and the second feed via 120*b* from the electronic element 300, the electrical signal is applied to the first feed pattern 130*a* and the second feed pattern 130*b* connected to the first feed via 120*a* and the second feed via 120*b*. As described above, the first feed pattern 130*a* and the second feed pattern 130*b* are not directly connected to the patch antenna pattern 110, and are disposed to overlap vertically along the third direction (z) to provide a coupling-type feeding path.

As such, since the first feed pattern 130*a* and the second feed pattern 130*b* are disposed to not directly contact the patch antenna pattern 110 to provide the coupling-type feeding path, a desired impedance may be provided to the patch antenna pattern 110 according to shapes of the first feed pattern 130*a* and the second feed pattern 130*b*, thus it is possible to adjust a resonance frequency and to improve a bandwidth of the patch antenna pattern 110.

Referring to FIG. 10 together with FIG. 9, the feed pattern 130 of the antenna device 1000*d* will be described. The feed pattern 130 of FIG. 10 may be one of the first feed pattern 130*a* and the second feed pattern 130*b*.

Referring to FIG. 10 together with FIG. 9, the feed patterns 130, 130*a*, and 130*b* include first pattern parts 131, 131*a*, and 131*b* connected to the feed vias 120, 120*a*, and 120*b*; second pattern parts 132, 132*a*, and 132*b* connected to the first pattern parts 131, 131*a*, and 131*b* and passing through the fourth dielectric layer 101*d*; and third pattern parts 133, 133*a*, and 133*b* connected to the second pattern parts 132, 132*a*, and 132*b* and extending toward a center of the patch antenna pattern 110 in a horizontal direction on the fourth dielectric layer 101*d*.

The first pattern parts 131, 131*a*, and 131*b*, the second pattern parts 132, 132*a*, and 132*b*, and the third pattern parts 133, 133*a*, and 133*b* may have coil shapes rotated in one direction, and the third pattern parts 133, 133*a*, and 133*b* may include a linear extension 134, 134*a*, and 134*b* extending toward the center of the patch antenna pattern 110.

As such, it is possible to power the patch antenna pattern 110 through the feed patterns 130, 130*a*, and 130*b* having the coil shape, and a current corresponding to an RF signal transmitted through the feed patterns 130, 130*a*, and 130*b* flows through the feed patterns 130, 130*a*, and 130*b*, and may rotate along the coil shape of the feed patterns 130, 130*a*, and 130*b*. Accordingly, since self-inductance of the feed patterns 130, 130*a*, and 130*b* may be boosted, the feed patterns 130, 130*a*, and 130*b* may have a relatively large inductance, and the patch antenna pattern 110 may have a wider bandwidth based on an additional resonance frequency corresponding to the inductance of the feed pattern 130. In addition, the current flowing along the coil shape may be concentrated in linear extensions 134, 134*a*, and 134*b* of the third pattern parts 133, 133*a*, and 133*b*, whereby concentration of electromagnetic coupling between the linear extensions 134, 134*a*, and 134*b* and the patch antenna pattern 110 may be increased, whereby the gain of the patch antenna patterns 110 may be improved.

As described above, the patch antenna pattern 110 is fed through two feed vias that are the first feed via 120*a* and the second feed via 120*b*, and a first surface current generated in the patch antenna pattern 110 by the first feed via 120*a* and the first feed pattern 130*a* and a second surface current generated in the antenna pattern 110 by the second feed via 120*b* and the second feed pattern 130*b* may be different, and they may flow in different directions.

At least a portion of the first RF signal propagated based on the first surface current and at least a portion of the second RF signal propagated based on the second surface current may be orthogonal to each other, and the higher the orthogonality between the first and second RF signals, the higher the gain of the first and second RF signals of the patch antenna pattern 110 may be. In this case, as mutual influence between a feed path through the first feed via 120*a* and a feed path through the second feed via 120*b* decreases, orthogonality between the first RF signal and the second RF signal may increase.

Referring to FIG. 11, the ground via 140 of the antenna device 1000*d* may be disposed to overlap a position of the patch antenna pattern 110 at which a sum of the first surface current generated in the patch antenna pattern 110 by the first feed via 120*a* and the first feed pattern 130*a* and the second surface current generated in the patch antenna pattern 110 by the second feed via 120*b* and the second feed pattern 130*b* is zero. For example, the ground via 140 may be positioned to overlap a central portion of the patch antenna pattern 110. In addition, a distance between the first feed via 120*a* and the ground via 140 may be the same as a distance between the second feed via 120*b* and the ground via 140, and the first horizontal connection part 142*a* between the ground via 140 and the first ground pattern 141*a* and the second horizontal connection part 142*b* between the ground via 140 and the second ground pattern 141*b* may be disposed to be perpendicular to each other.

As such, by disposing the ground via 140 to overlap the central portion of the patch antenna pattern 110, an influence between the first feed via 120*a* and the second feed via 120*b* can be reduced to increase an isolation degree, and accordingly, it is possible to reduce mutual interference between the first RF signal caused by the first surface current generated by the first feed via 120*a* and the first feed pattern 130*a* and the second RF signal caused by the second surface current generated by the second feed via 120*b* and the second feed pattern 130*b*. Therefore, orthogonality between the first RF signal and the second RF signal may be increased.

As described above, a height of the ground via 140 may be higher than heights of the first feed via 120*a*, the second feed via 120*b*, the first feed pattern 130*a*, and the second feed pattern 130*b* along the third direction (z) with respect to the ground plane 201, and it may be lower than a height of the patch antenna pattern 110. Accordingly, the isolation level between the first feed via 120*a* and the second feed via 120*b* may be increased, whereby the orthogonality between the first RF signal and the second RF signal may be increased.

In addition, the antenna device 1000*d* includes a plurality of sub-ground vias 143 positioned around the ground via 140, and the isolation level between the first feed via 120*a* and the second feed via 120*b* by the plurality of sub-ground vias 143 may be further increased.

In addition, the first ground pattern 141*a* and the second ground pattern 141*b* of the antenna device 1000*d* form additional electrical coupling with the first feed via 120*a* and the second feed via 120*b*, and thus the gain and bandwidth of the patch antenna pattern 110 may be improved. The first ground pattern 141*a* and the second ground pattern 141*b* of the antenna device 1000*d* have ring shapes surrounding the first feed via 120*a* and the second feed via 120*b*, respectively, but the configuration not limited thereto.

As shown in FIG. 8A, the first patch antenna pattern 110*a* of the patch antenna pattern 110 has a polygonal shape, and adjacent sides among respective sides 111*a*1, 111*a*2, 111*a*3, 111*a*4, 111*a*5, 111*a*6, 111*a*7, and 111*a*8 of the polygonal shape form an angle greater than 90 degrees, and thus, since it is possible to reduce mutual influence between currents flowing along the sides of the patch antenna pattern 110, the gain of the patch antenna pattern 110 for the first RF signal and the second RF signal may be increased.

In addition, since the plurality of second patch antenna patterns 110*b* positioned around the first patch antenna pattern 110*a* of the patch antenna pattern 110 may form additional impedance together with the first patch antenna pattern 110*a*, the bandwidth of the patch antenna pattern 110 may be increased without increasing a size of the patch antenna pattern 110.

Further, at least portions of the first and second feed patterns 130*a* and 130*b* respectively overlap portions of the plurality of second patch antenna patterns 110*b*, so that an electrical separation distance between the first feed pattern 130*a* and the second feed pattern 130*b* may be longer and the bandwidth of the patch antenna pattern 110 for the first RF signal and the second RF signal may be widened.

In addition, since the ground via 140 and the first ground pattern 141*a* and second ground pattern 141*b* act as a moving path of unnecessary frequency components that may occur around the patch antenna pattern 110, the unnecessary frequency components may be transmitted to the ground plane 201 through the ground via 140, the first ground pattern 141*a*, and the second ground pattern 141*b*, and thus, it is possible to prevent performance degradation of the antenna device according to a noise frequency component.

A current path flowing through the surface of the first patch antenna pattern 110*a* becomes long by the plurality of slits 112*a*1, 112*a*2, 112*a*3, and 112*a*4 adjacent to the first side 111*a*1, the second side 111*a*2, the third side 111*a*3, and the fourth side 111*a*4 of the first patch antenna pattern 110*a* of the patch antenna pattern 110, and thus, while reducing a size of the first patch antenna pattern 110*a*, a sufficient current path may be secured to increase the strengths of the first RF signal and the second RF signal by the current.

This will be described in more detail with reference to FIG. 12A and FIG. 12B along with FIG. 8A.

Referring to FIG. 12A together with FIG. 8A, the first patch antenna pattern 110*a* has a plurality of slits 112*a*1, 112*a*2, 112*a*3, and 112*a*4. As shown in FIG. 12A, a first feed electrical signal transmitted through a feed via and a feed pattern, for example, the first feed via 120*a* and the first feed pattern 130*a* is transmitted along a first path P1 from a signal applying part S positioned near the fifth side 111*a*5 of the first patch antenna pattern 110*a* adjacent to the first feed pattern 130*a* to the seventh side 111*a*7 facing the fifth side 111*a*5 of the first patch antenna pattern 110*a*. At the same time, it is transmitted along a second path P2 toward the sixth side 111*a*6 of the first patch antenna pattern 110*a* and along a third path P3 toward the eighth side 111*a*8 of the first patch antenna pattern 110*a*. In this case, among the plurality of slits 112*a*1, 112*a*2, 112*a*3, and 112*a*4, the second slit 112*a*2 and the fourth slit 112*a*4 adjacent to the second path P2 and the third path P3 make the paths of the currents flowing along the second path P2 and the third path P3 long.

Although not shown, a second feed electrical signal transmitted through the second feed via 120*b* and the second feed pattern 130*b* may be transmitted from the vicinity of the sixth side 111*a*6 of the first patch antenna pattern 110*a* adjacent to the second feed pattern 130*b* toward the eighth side 111*a*8, the fifth side 111*a*5, and the seventh side 111*a*7 of the first patch antenna pattern 110*a*.

Planar shapes of the plurality of slits 112*a*1, 112*a*2, 112*a*3, and 112*a*4 are shapes in which a rectangular shape having a narrow width at a position close to the center of the first patch antenna pattern 110*a* and a rectangular shape having a wide width at positions close to the first side 111*a*1, the second side 111*a*2, the third side 111*a*3, and the fourth side 111*a*4 of the first patch antenna pattern 110*a* are combined.

As described above, since the plurality of slits 112*a*1, 112*a*2, 112*a*3, and 112*a*4 have the shapes in which two quadrangular shapes having a wider width as being closer to an edge of the first patch antenna pattern 110*a* are combined, the path of the current flowing along the periphery of the plurality of slits 112*a*1, 112*a*2, 112*a*3, and 112*a*4 may be lengthened.

A first case (a) having a slit of a quadrangular shape with a constant width and a second case (b) having a slit having a shape in which a quadrangular shape with a narrow width and a quadrangular shape with a wide width are combined as in the antenna device according to the example will be compared and described with reference to FIG. 12B.

According to the first case (a), a direction of a current path P0 passing around the slit is changed once in a periphery of the slit, but according to the second case (b), a direction of a current path P passing around the slit is first changed near a portion of the slit with the narrow width and then is secondly changed near a portion of the slit with the wide width. As described above, the current path P in the second case (b) in which the direction of the current path is changed twice around the slit is longer than the current path P0 in the first case (a) in which the direction of the current path is changed once around the slit.

Since the first patch antenna pattern 110*a* of the antenna device according to the example has the plurality of slits 112*a*1, 112*a*2, 112*a*3, and 112*a*4 having the shapes in which the quadrangular shape with the narrow width and the quadrangular shape with the wide width are combined, even if the size of the first patch antenna pattern 110*a* is reduced, a current path flowing through the surface may be increased, and while reducing the size of the first patch antenna pattern 110*a*, a sufficient current path may be secured to increase strengths of the first RF signal and the second RF signal by the current.

According to the antenna device 1000*d*, since the first ground pattern 141*a* and the second ground pattern 141*b* positioned at the sides of the first feed via 120*a* and the second feed via 120*b* are included, it is possible to improve the gain and bandwidth of the patch antenna pattern 110 by inducing additional coupling, and by including the ground via 140 and the plurality of sub-ground vias 143 that are not connected to the patch antenna pattern 110 and have the higher heights than those of the first feed via 120*a* and the second feed via 120*b*, the isolation degree between the first feed via 120*a* and the second feed via 120*b* may be further increased to increase the gain and bandwidth of the antenna device.

In addition, by arranging the ground via 140 and the first ground pattern 141*a* and the second ground pattern 141*b* so as to overlap the patch antenna pattern 110 in the vertical direction between the ground plane 201 and the patch antenna pattern 110, it is possible to prevent the antenna device from becoming large for the arrangement of the ground via and the ground pattern.

Figure 13:
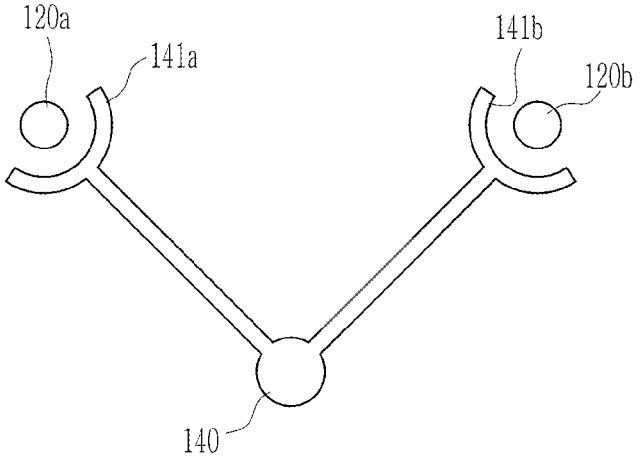
FIG. 13 illustrates a top plan view of a portion of an antenna device according to an example.

Hereinafter, a shape of a ground pattern according to other examples will be described with reference to FIG. 13 to FIG. 15. FIG. 13 illustrates a top plan view of a portion of an antenna device according to another example, FIG. 14 illustrates a top plan view of a portion of an antenna device according to a further example, and FIG. 15 illustrates a top plan view of a portion of an antenna device according to still another example.

Referring to FIG. 13, the first ground pattern 141*a* and the second ground pattern 141*b* extended from the ground via 140 have semi-ring-like planar shapes surrounding portions of the first feed via 120*a* and the second feed via 120*b*.

Figure 14:
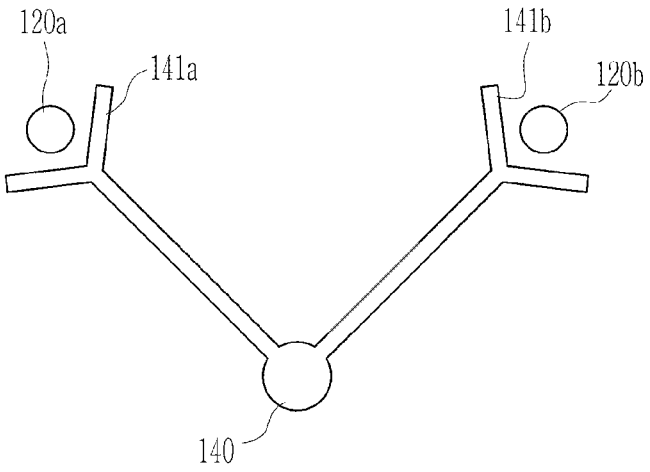
FIG. 14 illustrates a top plan view of a portion of an antenna device according to an example.

Referring to FIG. 14, the first ground pattern 141*a* and the second ground pattern 141*b* extended from the ground via 140 have Y-shaped planar shapes that surround portions of the first feed via 120*a* and the second feed via 120*b* and have rounded corners at both edges.

Figure 15:
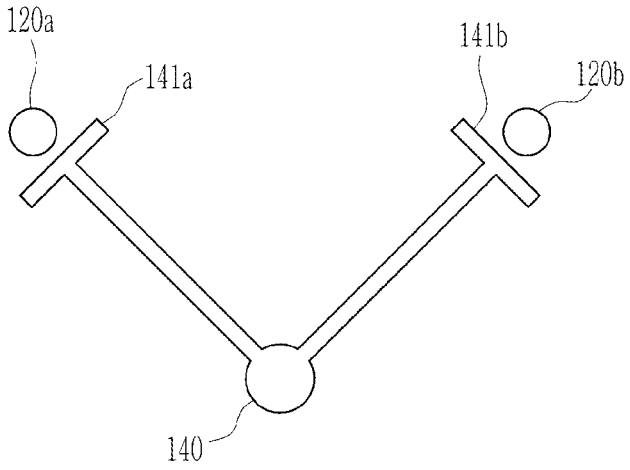
FIG. 15 illustrates a top plan view of a portion of an antenna device according to an example.

Referring to FIG. 15, the first ground pattern 141*a* and the second ground pattern 141*b* extended from the ground via 140 have planar shapes that are disposed to face the first feed via 120*a* and the second feed via 120*b* and that are long straight shapes.

The planar shapes and planar areas of the first ground pattern 141*a* and the second ground pattern 141*b* shown in FIG. 13 to FIG. 15, as an example of the first ground pattern 141*a* and the second ground pattern 141*b* of the antenna device according to the example, the planar shapes and sizes of the first ground pattern 141*a* and the second ground pattern 141*b* may be variously changed to adjust the sizes of the coupling between the first ground pattern 141*a* and second ground pattern 141*b* and the first feed via 120*a* and the second feed via 120*b* to desired sizes.

Figure 16A:
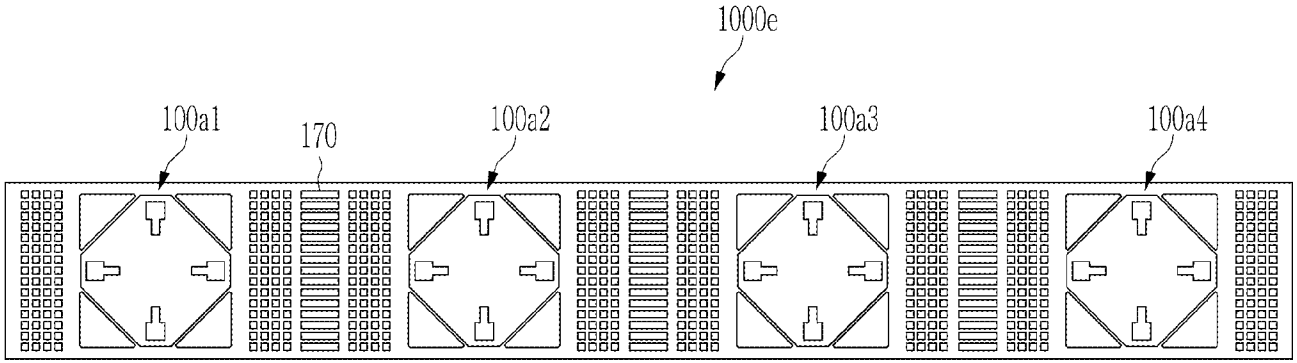
FIG. 16A illustrates a top plan view of an antenna device according to an example.
Figure 16B:
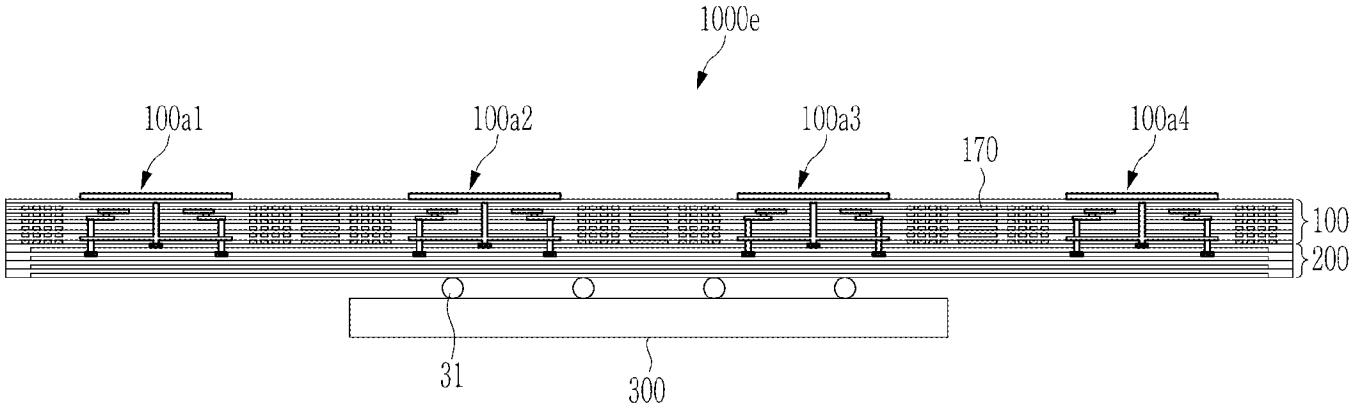
FIG. 16B illustrates a cross-sectional view of the antenna device of FIG. 16A.

Hereinafter, an antenna device including a plurality of antennas according to an example will be described with reference to FIG. 16A and FIG. 16B. FIG. 16A illustrates a top plan view of an antenna device 1000*e*, and FIG. 16B illustrates a cross-sectional view of the antenna device of FIG. 16A.

An antenna device 1000*e* includes a plurality of patch antennas 100*a*1, 100*a*2, 100*a*3, and 100*a*4.

The plurality of patch antennas 100*a*1, 100*a*2, 100*a*3, and 100*a*4 may be arranged in the first direction (x), and each of the patch antennas 100*a*1, 100*a*2, 100*a*3, and 100*a*4 may include all of the features of the antenna device 1000*d* described above.

The plurality of patch antennas 100*a*1, 100*a*2, 100*a*3, and 100*a*4 may be connected to one electronic element 300 through connectors 31 to receive an electrical signal.

A plurality of shielding patterns 170 are positioned between the plurality of patch antennas 100*a*1, 100*a*2, 100*a*3, and 100*a*4. Similar to the plurality of first dummy patterns 150 and the plurality of second dummy patterns 160, the plurality of shielding patterns 170 may be respectively positioned on the first dielectric layer 101*a*, the second dielectric layer 101*b*, the third dielectric layer 101*c*, the fourth dielectric layer 101*d*, the fifth dielectric layer 101*e*, and the sixth dielectric layer 101*f* of the plurality of dielectric layers 101*a*, 101*b*, 101*c*, 101*d*, 101*e*, 101*f*, and 101*g*, and they may have shapes in which a plurality of polygonal patterns are overlapped along the third direction (z) perpendicular to a surface of the patch antenna pattern 110. However, unlike the plurality of first dummy patterns 150 and the plurality of second dummy patterns 160, the plurality of shielding patterns 170 may have a planar shape having a straight shape extending in the first direction (x).

The plurality of shielding patterns 170 may be located between two patch antennas adjacent to each other, thereby increasing an isolation degree between the adjacent patch antennas to reduce interference between the adjacent antennas.

The features of the antenna devices according to the above-described examples may be applied to all of the disclosed antenna devices.

Figure 17A:
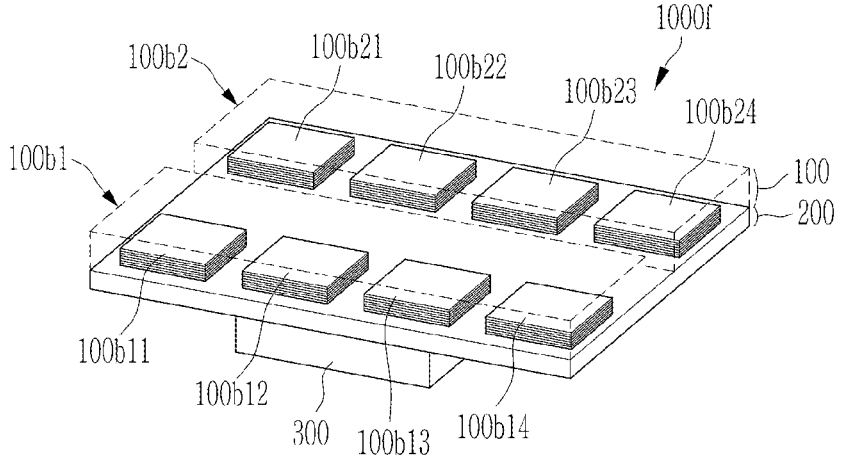
FIG. 17A and FIG. 17B illustrate perspective views of an antenna device according to an example.
Figure 17B:
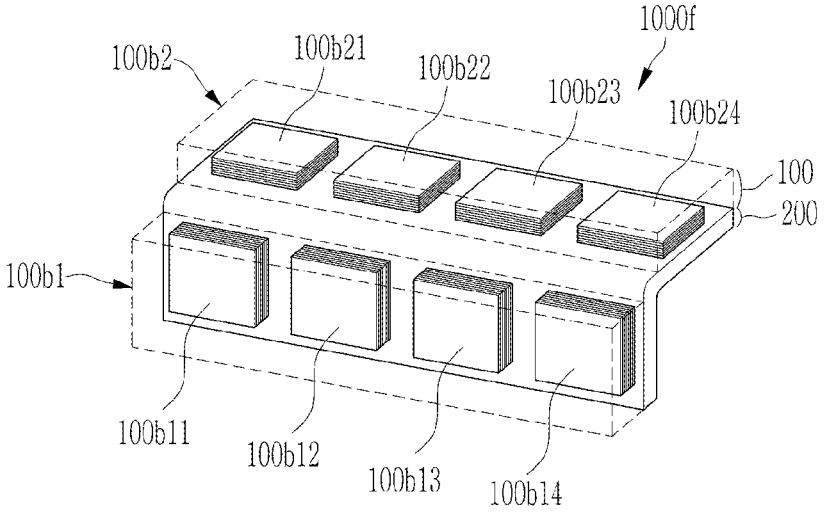

An antenna device including a plurality of antennas according to another example will be described with reference to FIG. 17A and FIG. 17B. FIG. 17A and FIG. 17B illustrate perspective views of an antenna device according to another example, and FIG. 17B illustrates a state in which a portion of the antenna device of FIG. 17A is bent.

Referring to FIG. 17A, an antenna device 1000*f* includes a first patch antenna group 100*b*1 and a second patch antenna group 100*b*2.

The first patch antenna group 100*b*1 includes a plurality of patch antennas 100*b*11, 100*b*12, 100*b*13, and 100*b*14 arranged in the first direction (x), and the second patch antenna group 100*b*2 includes a plurality of patch antennas 100*b*21, 100*b*22, 100*b*23, and 100*b*24.

The first patch antenna group 100*b*1 and the second patch antenna group 100*b*2 are spaced apart in the second direction (y) perpendicular to the first direction (x).

The first patch antenna group 100*b*1 and the second patch antenna group 100*b*2 may be attached to one connection part 200, and may be connected to one electronic element 300 positioned below the connection part 200 to receive an electrical signal from the electronic element 300.

The connection part 200 may be exposed between the first patch antenna group 100*b*1 and the second patch antenna group 100*b*2, and the connection part 200 may be a printed circuit board (PCB) and may be flexible.

Therefore, the connection part 200 between the first patch antenna group 100*b*1 and the second patch antenna group 100*b*2 may be bent.

As such, as shown in FIG. 17B, the connection part 200 between the first patch antenna group 100*b*1 and the second patch antenna group 100*b*2 may be bent such that the first patch antenna group 100*b*1 and the second patch antenna group 100*b*2 may be disposed on different planes.

Although not illustrated, the plurality of patch antennas 100*b*11, 100*b*12, 100*b*13, and 100*b*14 and the plurality of patch antennas 100*b*21, 100*b*22, 100*b*23, and 100*b*24 may include all of the features of the antenna devices according to the above-described examples.

Figure 18:
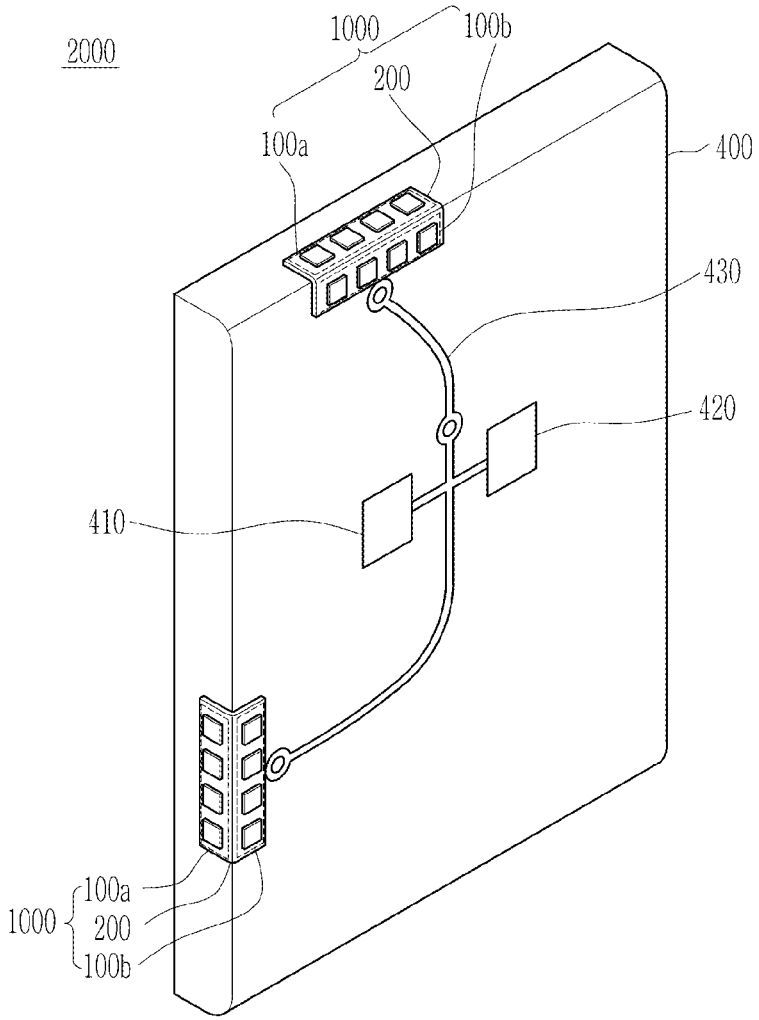
FIG. 18 illustrates a simplified view of an electronic device including an antenna device according to an example.

Hereinafter, an electronic device including an antenna device according to an example will be briefly described with reference to FIG. 18. FIG. 18 illustrates a simplified view of an electronic device including an antenna device according to an example.

Referring to FIG. 18, an electronic device 2000 includes an antenna device 1000, and the antenna device 1000 is disposed on a set substrate 400 of the electronic device 2000.

The electronic device 2000 is a smart phone, a personal digital assistant, a digital video camera, a digital still camera, a network system, a computer, a monitor, a tablet, a laptop computer, a netbook computer, a television, a video game device, a smart watch, an automotive device, etc., but is not limited thereto.

The electronic device 2000 may have sides of a polygon, and the antenna device 1000 may be disposed adjacent to at least some of a plurality of sides of the electronic device 2000.

Specifically, the antenna device 1000 may be electrically connected to one connection part 200, and may include a first antenna group 100*a* positioned on a lateral surface of the set substrate 400 of the electronic device 2000 and a second antenna group 100*b* positioned on a rear surface of the set substrate 400.

The connection part 200 between the first antenna group 100*a* and the second antenna group 100*b* is bendable, and accordingly, the first antenna group 100*a* and the second antenna group 100*b* may be disposed to be on different planes. Accordingly, the first antenna group 100*a* may be positioned on the lateral surface of the set substrate 400, and the second antenna group 100*b* may be positioned on the rear surface of the set substrate 400.

As described above, by connecting the antenna groups positioned on the lateral and rear surfaces of the set substrate of the electronic device to one connection part and one electronic element, since electrical signals may be simultaneously applied, while reducing an area occupied by the antenna device, it is possible to increase the ability of electronic devices to transmit and receive RF signals by arranging antenna groups in various directions.

A communication module 410 and a baseband circuit 420 may be disposed on the set substrate 400, and the antenna device 1000 may be electrically connected to the communication module 410 and the baseband circuit 420 through a coaxial cable 430.

In order to perform digital signal processing, the communication module 410 may include at least one of a memory chip such as a volatile memory (for example, a DRAM), a non-volatile memory (for example, a ROM), and a flash memory; an application processor chip such as a central processor (for example, a CPU), a graphics processor (for example, a GPU), a digital signal processor, a cryptographic processor, a microprocessor, and a microcontroller; and a logic chip such as an analog-to-digital converter and an application-specific IC (ASIC).

The baseband circuit 420 may perform analog-to-digital conversion, and amplification, filtering, and frequency conversion on an analog signal to generate a base signal. The base signal inputted/outputted from the baseband circuit 420 may be transmitted to the antenna device through a cable. For example, the base signal may be transmitted to an IC through an electrical connection structure, a core via, and a wire, and the IC may convert the base signal into an RF signal in a millimeter wave (mmWave) band.

Although not illustrated, the antennas in the first antenna group 100*a* and the second antenna group 100*b* of each antenna device 1000 may include all of the features of the antenna devices according to the above-described examples.

Figure 19A:
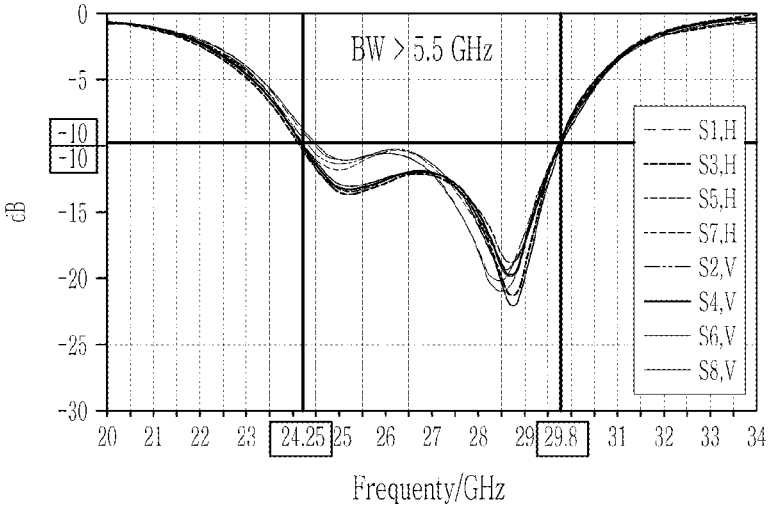
FIG. 19A and FIG. 19B illustrate graphs of bandwidth results of an antenna device according to an experimental example.
Figure 19B:
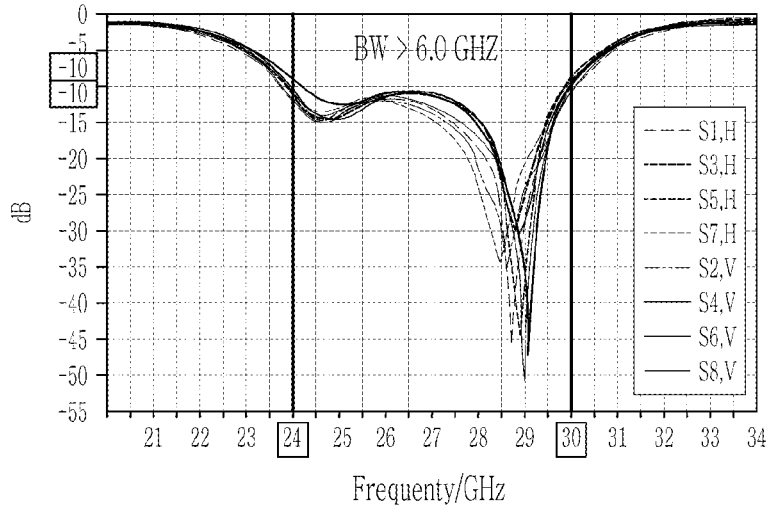

Hereinafter, an experimental example will be described with reference to FIG. 19A and FIG. 19B. FIG. 19A and FIG. 19B illustrate graphs of bandwidth results of an antenna device according to an experimental example.

In the present experimental example, scattering (S) parameters were measured for a first case in which the ground via 140 and the first ground pattern 141*a* and the second ground pattern 141*b* are not formed in the antenna device 1000*d* according to the above-described example and for a second case in which the ground via 140 and the first ground pattern 141*a* and the second ground pattern 141*b* are formed as in the antenna device 1000*d* according to the example, and the results were shown in FIG. 19A and FIG. 19B.

FIG. 19A shows the results of the first case, and FIG. 19B shows the results of the second case.

Referring to FIG. 19A and FIG. 19B, it can be seen that the bandwidth in the first case was about 5.5 GHz, and the bandwidth in the second case was about 6.0 GHz.

As described above, according to the second case in which the ground via 140 and the first ground pattern 141*a* and the second ground pattern 141*b* were formed as in the antenna device 1000*d* according to the example, it can be seen that the bandwidth of the antenna device increased.

Next, results of another experimental example will be described with reference to Table 1. In the present experimental example, gains of the antenna device according to frequencies were measured for the antenna device 1000*d* according to the above-described example. Gains of the antenna device according to the first feed electrical signal transmitted through the first feed via 120*a* and the first feed pattern 130*a* and gains of the antenna device according to the second feed electrical signal transmitted through the second feed via 120*b* and the second feed pattern 130*b* were measured, and the results are shown in Table 1 below. For example, the antenna device may have vertical polarization characteristics according to the first feed electrical signal, and the antenna device may have horizontal polarization characteristics according to the second feed electrical signal.

TABLE 1

| | Gain | |
|---|---|---|
| Frequency | First feed | Second feed |
| 24.25 GHz | 8.86 | 8.86 |
| 25.0 GHz | 9.31 | 9.30 |
| 26.0 GHz | 9.54 | 9.54 |

TABLE 1-continued

| Frequency | Gain | |
|---|---|---|
| | First feed | Second feed |
| 27.0 GHz | 9.83 | 9.85 |
| 28.0 GHz | 10.0 | 10.0 |
| 29.0 GHz | 9.84 | 9.91 |
| 29.5 GHz | 10.1 | 10.1 |
| Avg. | 9.64 | 9.65 |

Referring to Table 1, it can be seen that the antenna device had substantially the same gain depending on a frequency with different polarization characteristics, and also had a high gain at a high frequency.

While this disclosure includes specific examples, it will be apparent after an understanding of the disclosure of this application that various changes in form and details may be made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed in a different order, and/or if components in a described system, architecture, device, or circuit are combined in a different manner, and/or replaced or supplemented by other components or their equivalents. Therefore, the scope of the disclosure is defined not by the detailed description, but by the claims and their equivalents, and all variations within the scope of the claims and their equivalents are to be construed as being included in the disclosure.

What is claimed is:

1. An antenna device comprising:

a ground plane;

an antenna pattern overlapping the ground plane with respect to a first direction;

a dielectric layer interposed between the ground plane and the antenna pattern;

a feed via coupled with the antenna pattern and penetrating at least a portion of the dielectric layer;

a ground via connected to the ground plane and penetrating at least a portion of the dielectric layer; and a ground pattern extending from the ground via and disposed adjacent to a lateral surface of the feed via in a second direction that forms a predetermined angle with the first direction.

2. The antenna device of claim 1, wherein the ground via is spaced apart from the antenna pattern along the first direction, and the ground pattern overlaps the antenna pattern along the first direction.

3. The antenna device of claim 2, wherein a distance between the feed via and a center line passing through a center of the antenna pattern and extending in a direction parallel to the first direction is the same as a distance between the center line and the ground via.

4. The antenna device of claim 2, wherein the feed via is spaced apart from the antenna pattern along the first direction.

5. The antenna device of claim 4, further comprising a feed pattern connected to the feed via and spaced apart from the antenna pattern along the first direction and configured to provide a feeding path to the antenna pattern.

6. The antenna device of claim 4, wherein a height of the ground via measured from the ground plane along the first direction is greater than a height of the feed via measured from the ground plane along the first direction.

7. The antenna device of claim 2, wherein the feed via includes a first feed via and a second feed via spaced apart from the ground via in different directions, and the ground pattern includes a first ground pattern disposed on a lateral surface of the first feed via and a second ground pattern disposed on a lateral surface of the second feed via.

8. The antenna device of claim 7, wherein a height of the ground via measured along the first direction from the ground plane is greater than a height of the first feed via measured along the first direction from the ground plane or a height of the second feed via measured along the first direction from the ground plane.

9. The antenna device of claim 7, wherein a distance between the ground via and the first ground pattern is the same as a distance between the ground via and the second ground pattern, and on a plane perpendicular to the first direction, a first connection part between the first ground pattern and the ground via and a second connection part between the second ground pattern and the ground via are perpendicular to each other.

10. The antenna device of claim 7, wherein on a plane perpendicular to the first direction, the antenna pattern includes a first antenna pattern having a planar polygonal and a plurality of second antenna patterns spaced apart from the first antenna pattern along the second direction to surround the first antenna pattern.

11. An antenna device comprising:

a ground plane;

a dielectric layer disposed on the ground plane;

an antenna pattern disposed on the dielectric layer;

a first feed via and a second feed via coupled to the antenna pattern and penetrating a portion of the dielectric layer; and a ground via connected to the ground plane and spaced apart from the antenna pattern, and penetrating a portion of the dielectric layer, wherein a height of the ground via measured from the ground plane is greater than one or both of a height of the first feed via and a height of the second feed via measured from the ground plane.

12. The antenna device of claim 11, further comprising a first feed pattern connected to the first feed via and overlapping the antenna pattern with respect to a first direction in which the ground plane and the antenna pattern overlap each other and a second feed pattern connected to the second feed via and overlapping the antenna pattern with respect to the first direction, wherein the ground via is disposed closer to a center of the antenna pattern than the first feed via and the second feed via.

13. The antenna device of claim 12, wherein on a plane perpendicular to the first direction, the antenna pattern includes a first antenna pattern having a planar polygonal shape and a plurality of second antenna patterns spaced apart from the first antenna pattern to surround the first antenna pattern.

14. The antenna device of claim 13, wherein at least a portion of the first feed pattern and at least a portion of the second feed pattern overlap the plurality of second antenna patterns with respect to the first direction.

15. The antenna device of claim 11, further comprising:

a plurality of sub-ground vias connected to the ground plane and penetrating at least a portion of the dielectric layer, wherein the plurality of sub-ground vias surround the ground via, and a height of the plurality of sub-ground vias measured from the ground plane is greater than one or both of a height of the first feed via and a height of the second feed via measured from the ground plane.

16. The antenna device of claim 15, wherein the ground via and the plurality of sub-ground vias are spaced apart from the antenna pattern and overlap the antenna pattern.

17. An antenna device comprising:

a ground plane;

a first antenna pattern that overlaps the ground plane with respect to a first direction;

second antenna patterns that are coplanar with the first antenna pattern and surround portions of the first antenna pattern;

a dielectric layer disposed between the ground plane and the first antenna pattern and disposed between the ground plane and the second antenna patterns;

a feed via that penetrates at least a portion of the dielectric layer and overlaps one of the second antenna patterns with respect to the first direction;

a ground via that penetrates at least a portion of the dielectric layer and overlaps the first antenna pattern with respect to the first direction; and a ground pattern that extends from the ground via toward the feed via in a second direction that intersects the first direction.

18. The antenna device of claim 17, further comprising a feed pattern that extends from the feed via and overlaps the first antenna pattern and the one of the second antenna patterns with respect to the first direction.

19. The antenna device of claim 18, wherein the feed pattern comprises:

a first pattern part connected to the feed via and extending toward the ground via along the second direction;

a second pattern part connected to the first pattern part and extending toward the first antenna pattern along the first direction; and a third pattern part connected to the second pattern part and extending toward a center of the first antenna pattern along the second direction.

20. The antenna device of claim 17, wherein the first antenna pattern comprises a plurality of slits, each of the slits extending from a side of the of first antenna pattern adjacent to a respective second antenna pattern toward a center of the first antenna pattern along the second direction.

* * * * *